US006264767B1

(12) United States Patent
Frank et al.

(10) Patent No.: US 6,264,767 B1
(45) Date of Patent: Jul. 24, 2001

(54) METHOD OF PRODUCING MARTENSITE- OR BAINITE-RICH STEEL USING STECKEL MILL AND CONTROLLED COOLING

(75) Inventors: William R. Frank, Bettendorf; Jonathan Dorricott, Davenport, both of IA (US); Laurie E. Collins, Regina (CA); Joseph Duane Russo; Robert Joseph Boecker, both of Bettendorf, IA (US); Brian H. Wales, Davenport, IA (US)

(73) Assignee: IPSCO Enterprises Inc., Wilmington, DE (US)

( * ) Notice: Subject to any disclaimer, the term of this patent is extended or adjusted under 35 U.S.C. 154(b) by 0 days.

(21) Appl. No.: 09/350,314

(22) Filed: Jul. 9, 1999

Related U.S. Application Data

(63) Continuation-in-part of application No. 09/157,075, filed on Sep. 18, 1998, now abandoned, which is a continuation of application No. 09/113,428, filed on Jul. 10, 1998, which is a continuation of application No. 08/870,470, filed on Jun. 6, 1997, now Pat. No. 5,924,318, which is a continuation of application No. 08/594,704, filed on Jan. 31, 1996, now Pat. No. 5,810,951, which is a continuation of application No. 08/481,614, filed on Jun. 7, 1995, now Pat. No. 5,706,688.

(51) Int. Cl.[7] ..... C21D 8/02

(52) U.S. Cl. ..... 148/547; 148/602; 148/654

(58) Field of Search ..... 148/541, 546, 148/547, 602, 643, 644, 654, 661, 662, 663; 266/103, 113, 229, 201; 84/283.5, 89

(56) References Cited

U.S. PATENT DOCUMENTS

| | | |
|---|---|---|
| Re. 30,933 | 5/1982 | Toda et al. . |
| 3,806,376 | 4/1974 | Toda et al. . |
| 3,877,510 | 4/1975 | Tegtmeier et al. . |
| 3,885,741 | 5/1975 | Wagener et al. . |

(List continued on next page.)

FOREIGN PATENT DOCUMENTS

| | | |
|---|---|---|
| 26 30 877 | 11/1977 | (DE) . |
| 0 099 520 | 2/1984 | (EP) . |
| 0 123 406 | 10/1984 | (EP) . |
| 0 473 561 | 3/1992 | (EP) . |
| 0 177 187 | 4/1995 | (EP) . |
| 0 666 332 | 8/1995 | (EP) . |

(List continued on next page.)

OTHER PUBLICATIONS

The Association of Iron & Steel Engineers The Making, Shaping and Treating of Steel, 10th Edition, 1985, Chapter 41, Section 8, pp. 782–785.

(List continued on next page.)

*Primary Examiner*—Deborah Yee
(74) *Attorney, Agent, or Firm*—Robert H. Barrigar; Barrigar & Moss

(57) ABSTRACT

A steel rolling mill including a Steckel mill is provided with an in-line upstream quench station located downstream of the caster and upstream of the reheat furnace, a shear located downstream of the Steckel mill, and a temperature reduction station downstream of the shear. The upstream quench station has spray nozzles that quench a surface layer of the steel to transform same from an austenitic to a non-austenitic microstructure. The shear provides a precise transverse vertical face on the leading end of the steel. The temperature reduction station applies cooling fluid to the rolled steel so as to obtain a preferred microstructure that may be either bainite or martensite. If bainite, the temperature reduction station includes laminar-flow cooling apparatus; if martensite, the station also includes an initial rapid quench, in which latter case the station is followed by a tempering furnace.

10 Claims, 10 Drawing Sheets

U.S. PATENT DOCUMENTS

| | | | |
|---|---|---|---|
| 3,897,906 | | 8/1975 | Bachner . |
| 3,915,216 | | 10/1975 | Fekete et al. . |
| 3,935,896 | | 2/1976 | Tegtmeier et al. . |
| 3,941,611 | | 3/1976 | Greenberger . |
| 3,946,792 | | 3/1976 | Thalmann . |
| 3,964,938 | | 6/1976 | Tolliver et al. . |
| 3,981,347 | | 9/1976 | Willim . |
| 3,989,093 | | 11/1976 | Peitl et al. . |
| 4,006,633 | | 2/1977 | Shipman et al. . |
| 4,009,750 | | 3/1977 | Fekete et al. . |
| 4,031,946 | | 6/1977 | Marti et al. . |
| 4,043,384 | | 8/1977 | Piepenhagen et al. . |
| 4,047,985 | | 9/1977 | Greenberger . |
| 4,066,474 | | 1/1978 | Uchida et al. . |
| 4,073,332 | | 2/1978 | Etienne . |
| 4,142,923 | | 3/1979 | Satava . |
| 4,169,498 | | 10/1979 | Wilhelm . |
| 4,235,276 | | 11/1980 | Gilles et al. . |
| 4,250,951 | | 2/1981 | Mezger et al. . |
| 4,256,168 | | 3/1981 | Hein et al. . |
| 4,285,388 | | 8/1981 | Sevastakis . |
| 4,308,739 | | 1/1982 | Tippins . |
| 4,371,149 | | 2/1983 | Takeuchi et al. . |
| 4,375,998 | | 3/1983 | Bohnenkamp . |
| 4,422,303 | | 12/1983 | Rothenberg et al. . |
| 4,424,855 | | 1/1984 | Tsubakihara et al. . |
| 4,440,583 | | 4/1984 | Ikegami et al. . |
| 4,440,584 | | 4/1984 | Takeshige et al. . |
| 4,444,038 | | 4/1984 | Ginzburg . |
| 4,452,061 | | 6/1984 | Numano et al. . |
| 4,463,795 | | 8/1984 | Chielens et al. . |
| 4,473,106 | | 9/1984 | Sautebin . |
| 4,476,914 | | 10/1984 | Wrossok . |
| 4,483,387 | | 11/1984 | Chielens et al. . |
| 4,505,141 | | 3/1985 | Thomas et al. . |
| 4,508,160 | | 4/1985 | Sautebin . |
| 4,562,880 | | 1/1986 | Larrecq et al. . |
| 4,567,934 | | 2/1986 | Nakao et al. . |
| 4,572,280 | | 2/1986 | Haller . |
| 4,583,387 | | 4/1986 | Thomas et al. . |
| 4,592,510 | | 6/1986 | Grothe . |
| 4,610,735 | | 9/1986 | Dubost . |
| 4,658,882 | | 4/1987 | Oba et al. . |
| 4,675,974 | | 6/1987 | Connolly . |
| 4,699,202 | | 10/1987 | Gilles . |
| 4,705,096 | | 11/1987 | Chia . |
| 4,723,562 | | 2/1988 | Wilmotte et al. . |
| 4,765,390 | | 8/1988 | Vaterlaus . |
| 4,901,785 | | 2/1990 | Dykes et al. . |
| 4,934,445 | | 6/1990 | Plata et al. . |
| 4,986,857 | | 1/1991 | Hewitt . |
| 4,987,950 | | 1/1991 | Yu . |
| 5,063,991 | | 11/1991 | Bobadilla et al. . |
| 5,085,264 | | 2/1992 | Jolivet et al. . |
| 5,094,094 | | 3/1992 | Muramatsu et al. . |
| 5,112,412 | | 5/1992 | Plata et al. . |
| 5,119,883 | | 6/1992 | Wagstaff et al. . |
| 5,148,853 | | 9/1992 | Yu et al. . |
| 5,201,363 | | 4/1993 | Demarez et al. . |
| 5,235,840 | | 8/1993 | Blazevic . |
| 5,276,952 | | 1/1994 | Thomas et al. . |
| 5,284,327 | | 2/1994 | Arthur et al. . |
| 5,285,670 | | 2/1994 | Thomas . |
| 5,289,867 | | 3/1994 | Barker et al. . |
| 5,382,306 | | 1/1995 | Plata et al. . |
| 5,413,314 | | 5/1995 | Plata et al. . |
| 5,414,923 | * | 5/1995 | Thomas et al. ..... 29/527.7 |
| 5,467,519 | | 11/1995 | Tippins et al. . |
| 5,493,766 | * | 2/1996 | Yamakawa et al. ..... 148/541 |
| 5,499,523 | | 3/1996 | Ginzburg . |
| 5,540,074 | | 7/1996 | Smith et al. . |
| 5,634,512 | | 6/1997 | Bombardelli et al. . |
| 5,638,714 | | 6/1997 | Ryan et al. . |
| 5,665,181 | * | 9/1997 | Rhode ..... 148/541 |
| 5,706,690 | | 1/1998 | Connolly . |
| 5,752,403 | | 5/1998 | Tippins et al. . |

FOREIGN PATENT DOCUMENTS

| | | |
|---|---|---|
| 2 001 673 | 2/1979 | (GB) . |
| 2 129 723 | 5/1984 | (GB) . |
| 2 134 022 | 8/1984 | (GB) . |
| 62-174323 | 7/1987 | (JP) . |
| 62-196325 | 8/1987 | (JP) . |
| 86/01231 | 2/1986 | (WO) . |
| 92/21454 | 12/1992 | (WO) . |
| 95/13149 | 5/1995 | (WO) . |

OTHER PUBLICATIONS

Cohen and Hansen, On the Fundamentals of HSLA Steels, HSLA Steels Metallurgical Applications, Proceedings and Conference, Bejing, China, 1985, pp. 61–70.

T. Ponchelet, R. Lammar, M. Mertens, G. Lessel, A. Frantz (ARBED) S. Wilmotte, J.F. Noville, M. Economopoulos (CRM); Fabrication de toles fortes HLE par trempe et autorevenu; Dec. 1995; pp. 867–874.

* cited by examiner

METHOD OF PRODUCING MARTENSITE- OR BAINITE-RICH STEEL USING STECKEL MILL AND CONTROLLED COOLING

RELATED APPLICATIONS

This is a continuation-in-part application of (1) U.S. application Ser. No. 09/157,075, now abandoned which is a continuation of U.S. application Ser. No. 08/594,704, filed Jan. 31, 1996, now issued as U.S. Pat. No. 5,810,951, and (2) U.S. application Ser. No. 08,870,470, filed Jun. 6, 1997 which is a continuation of U.S. application Ser. No. 08/481, 614, filed Jun. 7, 1995, now issued as U.S. Pat. No. 5,706, 688 and (3) U.S. application Ser. No. 09/113,428. This application also claims priority from U.S. application Ser. No. 09/113,428 filed Jul. 10, 1998.

FIELD OF INVENTION

This invention relates to an apparatus combination in or for use in a steel-making mill, and a preferred method of operating same.

BACKGROUND OF THE INVENTION

In in-line rolling mills, high speeds of operation are essential if undue cooling of the steel below optimal rolling temperatures is to be avoided. Consequently, in such mills, control of both internal microstructure and of external surface properties is difficult to achieve to produce optimum metallurgical characteristics in the finished steel product.

In a conventional continuous casting steel mill using a reversing rolling mill such as a Steckel mill for rolling, steel is cast into a strand by a caster, is severed into slabs or other preferred portions downstream of the caster, and passes to a reheat furnace where it is heated to a uniform pre-rolling temperature. From the reheat furnace, the steel may be rolled by an initial roughing mill, but at least the final rolling steps are effected by a Steckel mill. If thicker plate product is produced by the Steckel mill, the Steckel mill rolling is confined to flat-pass rolling. For thinner, coilable plate and strip product the steel may be coiled within the coiler furnace during at least the later rolling passes. Following rolling, the steel is typically cooled, and if finished as a plate product, is conventionally passed through a hot leveller or cold leveller or both. Coilable products are typically up-coiled or down-coiled and offloaded for shipment; flat plate is cut to preferred length and may be subjected to final cooling on a cooling bed before stacking and shipment.

The use of a Steckel mill to roll steel is well established in industrial practice and in the technical literature. However, the optimization of steel quality from both a surface standpoint and an internal microstructure standpoint, especially for flat steel plate products, has not been achieved by others. In particular, it has not been understood prior to the development of the present invention by the present inventors that a unique combination of steel cooling, steel heating and steel reduction steps, taken in a controlled manner between the caster and the end of the downstream line, can lead to preferred surface and metallurgical characteristics in finished steel plate.

SUMMARY OF THE INVENTION

We have found that optimal metallurgical characteristics of the steel thus produced, and particularly steel plate products thus produced, may be optimized by a careful selection of the combination of apparatus that is provided between the caster and the more remote downstream apparatus, and if appropriate operational constraints are applied to this combination of equipment.

Generally speaking, preferred metallurgical results require an overall reduction in thickness of the steel of at least about 3:1. Consequently, if the objective is to make ½" plate, the initial casting must be at least 1.5" thick. Further, for various other reasons it may be preferred to use castings of greater thickness than three times the target end-product thickness. The present invention is preferably used with castings of at least about 3 inches in thickness.

Specifically, the apparatus combination protected by this invention comprises a quench facility located downstream of the caster and upstream of the reheat furnace ("upstream quench station"), and a controlled temperature reduction facility located closely downstream of a Steckel mill or other similar reversing rolling mill. Note that "closely" does not preclude the possible installation of devices between the Steckel mill and temperature reduction facility. A hot flying shear or other suitable severing device is also required; ideally two hot flying shears one upstream and one downstream of the temperature reduction facility would be used. However, depending upon the intended use of the rolling mill, it is possible to make do with one flying shear. Some preferred uses of the rolling mill favour upstream location of the flying shear; others favour downstream location. For example, some of the rolling optimization aspects of the invention and the objective of presenting a clean vertical leading edge of the steel to the downstream quench station favour an upstream location of the hot flying shear. On the other hand, the need to accelerate a leading severed portion of the steel relative to a trailing portion when the steel is cut to length favours a cut-to-length flying shear downstream of the temperature reduction facility. The applicable considerations will be reviewed further later in this specification. To accommodate all possible objectives, two shears may be provided—one upstream of the temperature reduction facility, and one downstream. If the mill is to produce steel of an appreciable range of thicknesses, one type of shear could be provided for thinner steel, another type for thicker steel. Further, some shears work well only for hot steel, others for cold. The mill designer will take these points into consideration in the overall equipment selection and design.

The upstream quench station may be located either upstream or downstream of the slab severing apparatus (typically a cutting torch). This upstream quench station is constrained to apply to the steel a controlled surface quench with a depth of penetration of at least ½ inch, and preferably no more than about ¾ inch (while quench penetration deeper than ¾ inch is metallurgically tolerable, it conveys no additional benefit so far as the steel surface quality is concerned, and the greater the depth of penetration of the quench, the greater the amount of heat required in the reheat furnace to heat the steel to uniform pre-rolling temperature, and thus the higher the cost of production). The quench imparted to the steel must be sufficient to alter the surface layer of the steel from austenite to some other microstructure such as ferrite or pearlite. Preferably the quench is initiated when the surface temperature is at or above the austenite-ferrite transformation start temperature $Ar_3$, although start temperatures somewhat below the $Ar_3$ can be tolerated, even though such lower temperatures are not optimum. A reduction in temperature by the quench station in the order of about 250–300° C. is preferably effected. Assuming a preferred start temperature at or above the steel's transformation start temperature $Ar_3$, a suitable completion temperature is at or below the steel's austenite-ferrite transformation completion temperature $Ar_1$.

The steel transformation start and completion temperatures $Ar_3$, $Ar_1$ depend on the type of steel that is cast and the cooling rate. Most types of steel cast in a conventional continuous casting mill are suitable for application of the invention; for example, typical plain carbon steels suitable for quenching in accordance with the invention include steels having 0.03–0.2% carbon content. The cooling rate of a steel product is not constant throughout its body; cooling rates differ at different depths beneath the product surface. Different cooling rates will transform austenite to different combinations of transformation products; as the steel's cooling rate varies with strand depth, it follows that the transformed microstructure will differ with strand depth.

For optimal results, the quench should be applied in a manner that responds to the surface temperature gradient of the casting, which typically is hotter at the inner surface portions near the longitudinal centre of the casting than at the outer side edges of the casting. To this end, a transversely differential spray is arranged within the quench unit. Since spray applied above the casting is typically more effective than spray applied underneath the casting, the ratio of bottom spray flow rates to top spray flow rates is preferably in about the range of 1.2 to 1.5. Since the side edges of the casting tend to cool more rapidly than the central portions, and since there is a tendency of any accumulation of surface water to flow from the central portion over the side edges, no spray may be required for the side edges, and further, the side edges may be protected against overcooling. Such protection may include longitudinally extending suction devices overlying the side edges (adjustable for width of casting) and masking of the side edges to impede cooling spray.

Further fine control of the quench spray may be provided to accommodate changes in casting speed, and other variations that could result in non-uniform quenching of upper and lower surfaces of the casting.

The upstream quench station facilitates the production of plate having a surface relatively free of defects.

In the reheat furnace, the steel is reheated to a uniform pre-rolling temperature suitably above temperature $T_{nr}$ being the temperature below which there is little or no austenite. Rolling in a Steckel mill proceeds with the inevitable pauses between passes to permit the steel to decelerate and the Steckel mill to reverse the direction of rolling pass and to accelerate the steel for the next following reduction. These pauses permit a greater opportunity for controlled recrystallization of the steel to occur while the temperature of the steel is above the $T_{nr}$ than is available for in-line rolling through a series of sequential roll stands. Preferably, any given portion of the steel is at "rest" (not subjected to a reduction operation) for a cumulative total "rest" time of at least about 60 seconds during the rolling procedure so as to optimize the controlled recrystallization (by "rest" is not meant that the steel is not moving longitudinally; by "rest" is meant that the steel is not being actively reduced by the Steckel mill rolls). If the intermediate steel product is coilable within the coiler furnace, some rolling above the $T_{nr}$ may be effected at steel thicknesses below the minimum coilable thickness of the steel while using the Steckel mill coiler furnaces for winding of the steel between passes, and the heat within the coiler furnaces may impede temperature drop of the steel below the $T_{nr}$, thus making possible a greater amount of time during which controlled recrystallization can occur than would be the case if the coiler furnaces cannot be used. On the other hand, steel that is to be rolled to thicker end products tends to retain heat to a greater extent than thinner steel products, and consequently may be flat-passed rolled for a sufficient number of passes above the $T_{nr}$ that an adequate amount of controlled recrystallization can occur.

For optimum metallurgical results, the steel is rolled above the $T_{nr}$ for a selected number of rolling passes to achieve a reduction of the steel of at least about 1.5:1. Thereafter, the steel is rolled below the $T_{nr}$ for a further selected number of rolling passes so as to achieve a further reduction of the steel of the order of 2:1. The combined effect of the first and second reductions is, therefore, an overall reduction of at least about 3:1, which is considered to be the appropriate minimum for the obtention of preferred metallurgical results. The second reduction is preferably completed at an exit temperature from the rolling mill at about the $Ar_3$.

During the reduction rolling below the $T_{nr}$, the fine-grained austenitic mircrostructure that was obtained by controlled recrystallization is pancaked i. e. flattened. The eventual microstructure desired in the eventual steel product will vary considerably depending upon the expected end use of the product. Such preferred microstructure is achieved by a controlled cooling of the steel after the last reduction pass through the Steckel mill.

The controlled cooling should be effected so that upper and lower surfaces of the steel are subjected to this initial cooling simultaneously and uniformly. To this end, a hot-flying shear or equivalent transverse shearing devise should provide a leading edge of the steel to be cooled that is precisely transverse, planar and vertical within engineering limits. As previously noted, this objective is served by locating a hot flying shear between the Steckel mill and the temperature reduction facility.

The nature of the controlled cooling is selected to meet the metallurgical objectives for the end product to be produced. Two different end products will be discussed in this specification by way of example.

A first suitable choice of end produce is one containing a high proportion of fine-grained bainite. Such steels have a good combination of strength, toughness and ductility. To this end, immediately downstream of the hot-flying shear, or equivalent severing device, is an controlled cooling station that facilitates production of the high-bainite-content product.

The steel, at about the $Ar_3$ temperature, is subjected in the controlled cooling station to controlled cooling of about 12 C. to about 20 C. per second, and preferably about 15 C. per second, so as to reduce the temperature of the steel by at least about 200 C. and preferably at least about 250 C. Since the $Ar_3$ for most commercial grades of steel of interest is typically of the order of 800 C. or at least in the range of about 750–800 C., it follows that the exit temperature from the cooling station will be no higher than 600 C. and typically no lower than about 450 C., and most probably and preferably in the range of about 470 C. to about 570 C. The temperature drop imparted by the controlled cooling can be more than 250 C. below the $Ar_3$, but should not be more than about 400 C. below the $Ar_3$ and preferably in the range about 250 C. to about 350 C. below the $Ar_3$.

The controlled cooling station is preferably laminar flow cooling apparatus so far as the upper surface of the steel being processed is concerned; the undersurface of the steel product is preferably cooled by a quasi-laminar spray. The usual spray medium is water, maintained within conventional temperature ranges.

The amount of the temperature drop from the $Ar_3$ imparted by the controlled cooling will depend upon the chemistry (alloy composition) of the steel being rolled, in the discretion of the metallurgist who is responsible for the steel processing.

Another example of a suitable steel product to be produced is plate having a high proportion of fine-grained martensite. In such case, the controlled cooling facility downstream of the hot-flying shear, or equivalent device, would be a quench station ("downstream quench station") followed by a laminar-flow cooling facility, and in turn followed by a tempering furnace off-line. The downstream quench station would impart an initial severe quench do this steel; the laminar-flow cooling to follow would maintain cooling of the steel at a rate preferably equal to the maximum rate permitted by the heat-transfer characteristics of the steel.

More particularly, after being cut by the hot-flying shear, the steel is passed through and is rapidly cooled by a roller pressure quench (RPQ) apparatus, thereby transforming the surface layers of the product into martensite. As a result of the quenching, the product's surface is chilled to about the temperature of the applied cooling fluid. The product then passes through and is further cooled in a controlled cooling station. The controlled cooling maintains the temperature of the chilled surface layer, thereby providing a maximum temperature gradient between the surface and the product core, in turn enabling a maximum rate of heat dissipation out of the core. The rate of heat dissipation and the temperature of product after controlled cooling exceeds the critical martensite cooling rate, and the temperature within the steel falls below the martensite start temperature throughout most if not all of the product, thereby transforming as much martensite as the chemistry and cooling rate will permit. Optionally, the RPQ quench unit may be modified to provide tensioning of the steel between its input and output rolls (in a manner similar to that provided conventionally in some types of hot levelling apparatus) to promote flatness of the steel and possibly to improve its surface quality. Optionally the RPQ quench unit may be provided with suction devices in the vicinity of the spray nozzle orifices to remove water from the surface of the steel.

Note that production of bainite-rich or martensite-rich steels both require a laminar-flow cooling or equivalent controlled cooling facility; the difference is that production of the martensite-rich steel requires also a quench station and an off-line tempering furnace. Accordingly, the steel mill may be arranged to provide the facility required for martensite-rich steel production, and when the mill produces bainite-rich steel, the quench station downstream of the Steckel mill will be idle and only the laminar flow controlled cooling station will be used. The laminar flow cooling facility or equivalent will have to accommodate production of both types of steel if both are to be produced by the mill; to this end, the controlled cooling facility should be designed to provide maximum flow to meet peak production requirements, with the availability of reduced flow or of idling some banks of nozzles if maximum flow is not required. The tempering furnace, being off-line, would in any case not interfere with continuted on-line processing of bainite-rich steel product.

If tempering of martensite-rich steel plate is to be effected, the product is after quenching and cooling in the controlled cooling facility optionally levelled in a hot leveller, in essentially the same manner as a bainite-rich product. Then, the product in accordance with conventional practice passes to a transfer table and thence transversely to a cooling bed. Then, the product is taken off-line and transferred into in a tempering furnace and heated for a suitable tempering period and at a suitable tempering temperature. The temperature allows the reconstitution of entrapped carbon, thereby increasing the ductility of the steel. After tempering the martensite-rich steel possesses high strength and hardness typically characteristic of quench-and-tempered steels.

The resulting plate steel product produced by apparatus according to the invention is of a preferred fine-grained microstructure whose character will depend upon the nature of the controlled cooling downstream of the hot-flying shear. The steel product will have a surface relatively free of defects by reason of the quench imparted immediately downstream of the caster. The product will have a fine-grained microstructure by reason of the controlled recrystallization that occurs during the initial flat-pass rolling of the steel above the $T_{nr}$ and the controlled cooling downstream of the Steckel mill. This preferred combination of metallurgical characteristics is obtainable in an optimally economical manner by the apparatus combination of the present invention.

THE DRAWINGS

A detailed description of the preferred embodiment is provided herein below with reference to the accompanying drawings, in which.

DETAILED DESCRIPTION WITH REFERENCE TO ACCOMPANYING DRAWINGS

Figure 1:
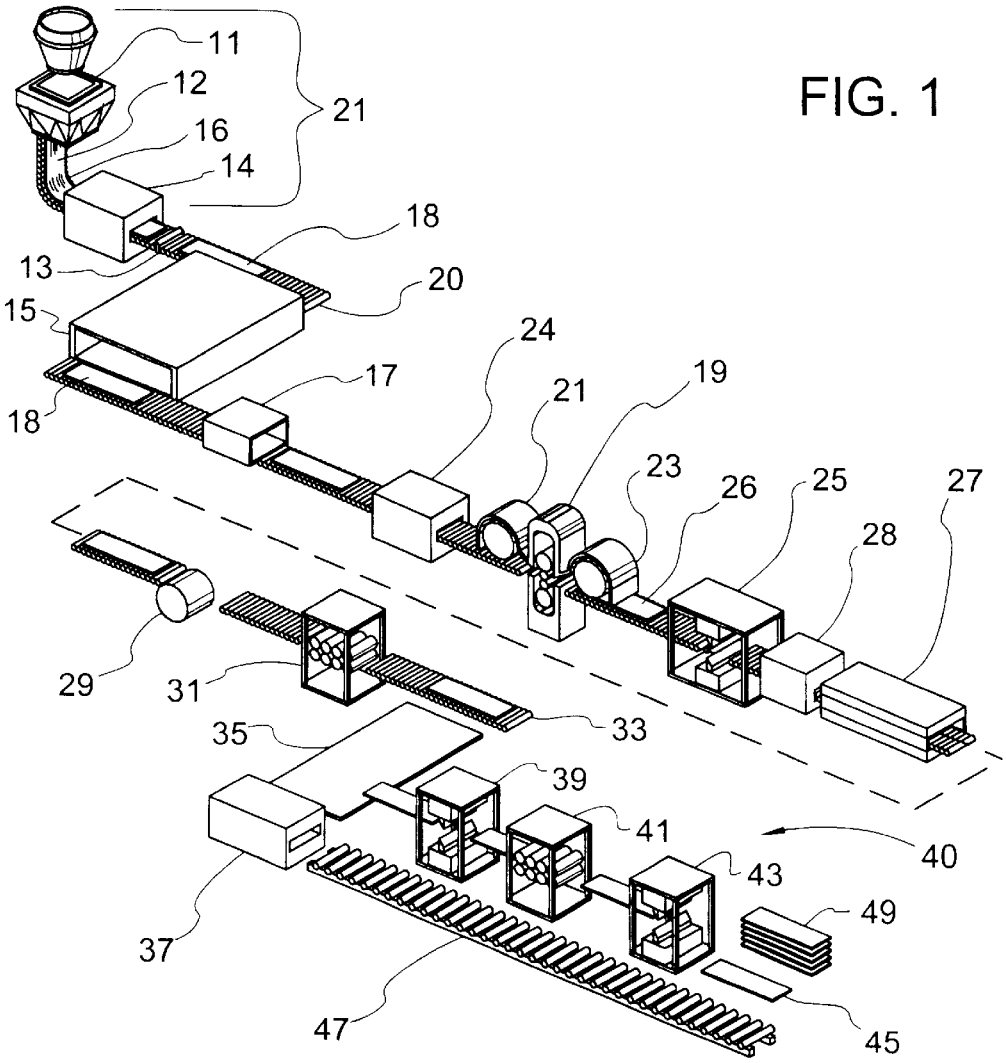
FIG. 1 is a schematic perspective diagram of a steel casting and rolling mill incorporating a caster assembly, upstream quench station, reheat furnace, Steckel Mill, hot flying shear, downstream quench station, controlled cooling station, and tempering furnace in accordance with principles of the present invention.

Referring to FIG. 1, molten steel is supplied to a caster 11 that casts molten steel into a cast steel strand 12. The strand 12 exits the caster 11 and enters a strand containment and redirection apparatus 16 wherein it forms a solidified thin skin, moves from a generally vertical position to a generally horizontal position, and is straightened. The devices just described collectively constitute a caster assembly 21.

Figure 2:
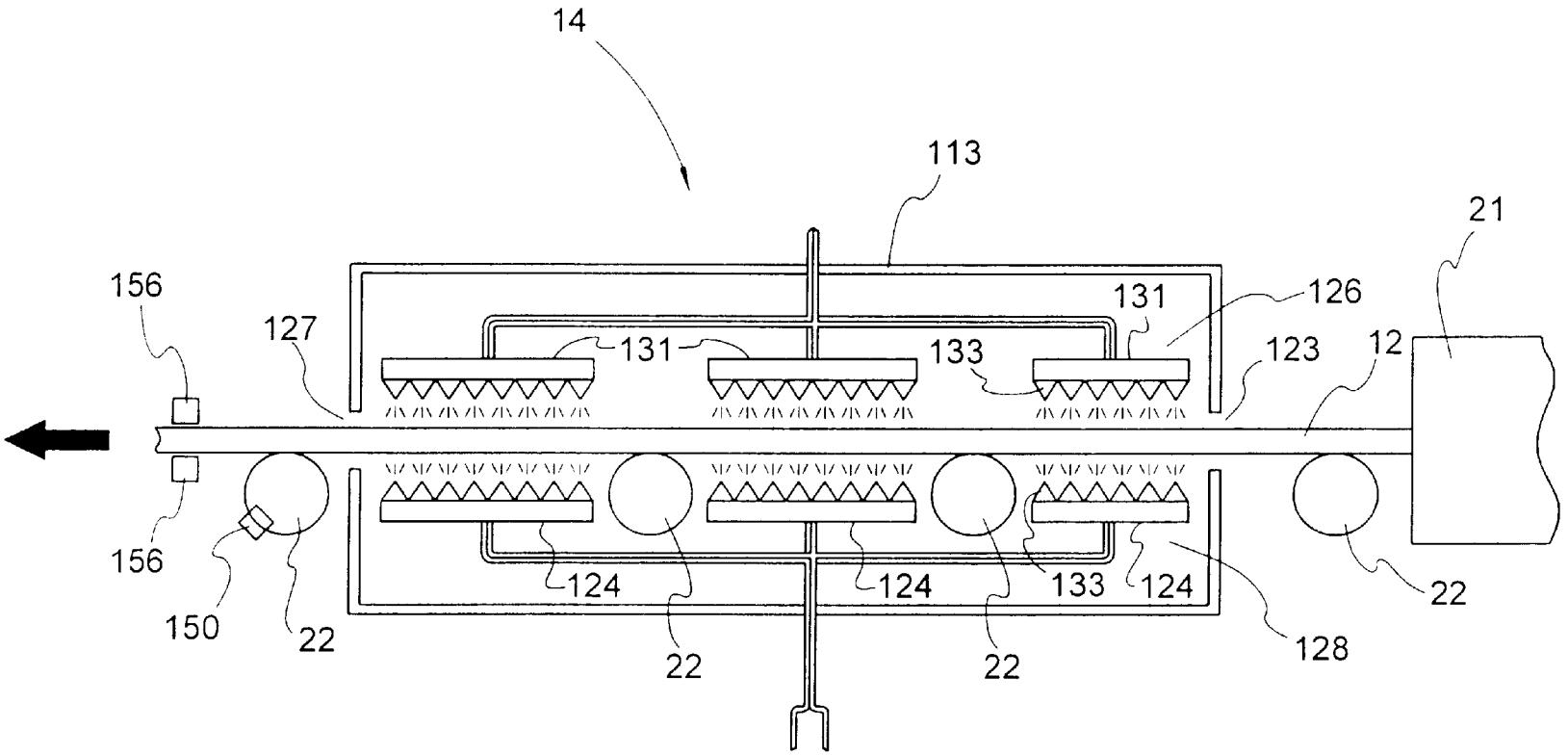
FIG. 2 is a schematic interior side elevation fragment view of an embodiment of the upstream quench station according to the invention.

Referring to FIG. 2, after exiting the strand containment and redirection apparatus 16, the strand 12 is fed by a series of rollers 22 into a upstream quench station 14 located closely downstream and in-line to the caster 11. The upstream quench station 14 has a housing 113 surrounding the strand 12. Selected portions of the strand 12 are quenched by a plurality of intense sprays of water and air combined into an air mist applied by clusters of top spray nozzles 131 and bottom spray nozzles 124. (Air mist tends to be more efficient than water to cool steel; however, a water-only spray may be suitable but not preferred). As a result of the quench, the steel is rapidly cooled from its pre-quench start temperature to a suitable completion temperature so that the steel's microstructure is changed from austenite to one or more suitable microconstituents, such as ferrite and pearlite. It has been found that effecting a surface quench to a suitable depth, then reheating the steel in a reheat furnace 15 downstream of a severing apparatus 13, reduces or prevents altogether the occurrence of surface defects in the steel product. Suitable transformed microstructures include ferrite and pearlite, bainite or, martensite and ferrite, or some combination of two or more of these. The preferred start temperature is at or above the steel's austenite-ferrite transformation start temperature $Ar_3$ and the suitable completion temperature is at or below the steel's austenite-ferrite transformation completion temperature $Ar_1$. It has been found that quenching from a start temperature below the transformation start temperature $Ar_3$ is in some cases acceptable but not preferred, as quenching in this temperature range provides some but not as much reduction in the occurrence of surface defects as quenching from a temperature above the transformation start temperature $Ar_3$.

The steel transformation start and completion temperatures $Ar_3$, $Ar_1$ depend on the type of steel that is cast and the cooling rate. Most types of steel cast in a conventional continuous casting mill are suitable for application of the invention; for example, typical plain carbon steels suitable for quenching in accordance with the invention include steels having 0.03–0.2% carbon content. The cooling rate of a steel product is not constant throughout its body; cooling rates differ at different depths beneath the product surface. Different cooling rates will transform austenite to different combinations of transformation products; as the steel's cooling rate varies with strand depth, it follows that the transformed microstructure will differ with strand depth. It has been found that a minimum transformed depth of about ½ to ¾ inch will satisfactorily reduce the occurrence of surface defects.

The spray nozzle clusters 131, 124 are respectively arranged into a top array 126 and a bottom array 128, wherein each array 126, 128 applies cooling spray to an associated top and bottom surface of the strand 12. The appropriate proportions of cooling fluid that should be applied respectively to the top and bottom surfaces so that both surfaces are quenched to the same depth can be empirically determined by removing test portions of the quenched strand and examining their cross-section. The appropriate proportion can then be programmed into the control system for the quench so that subsequently quenched portions of the strand will be quenched to the required depth.

Figure 3:
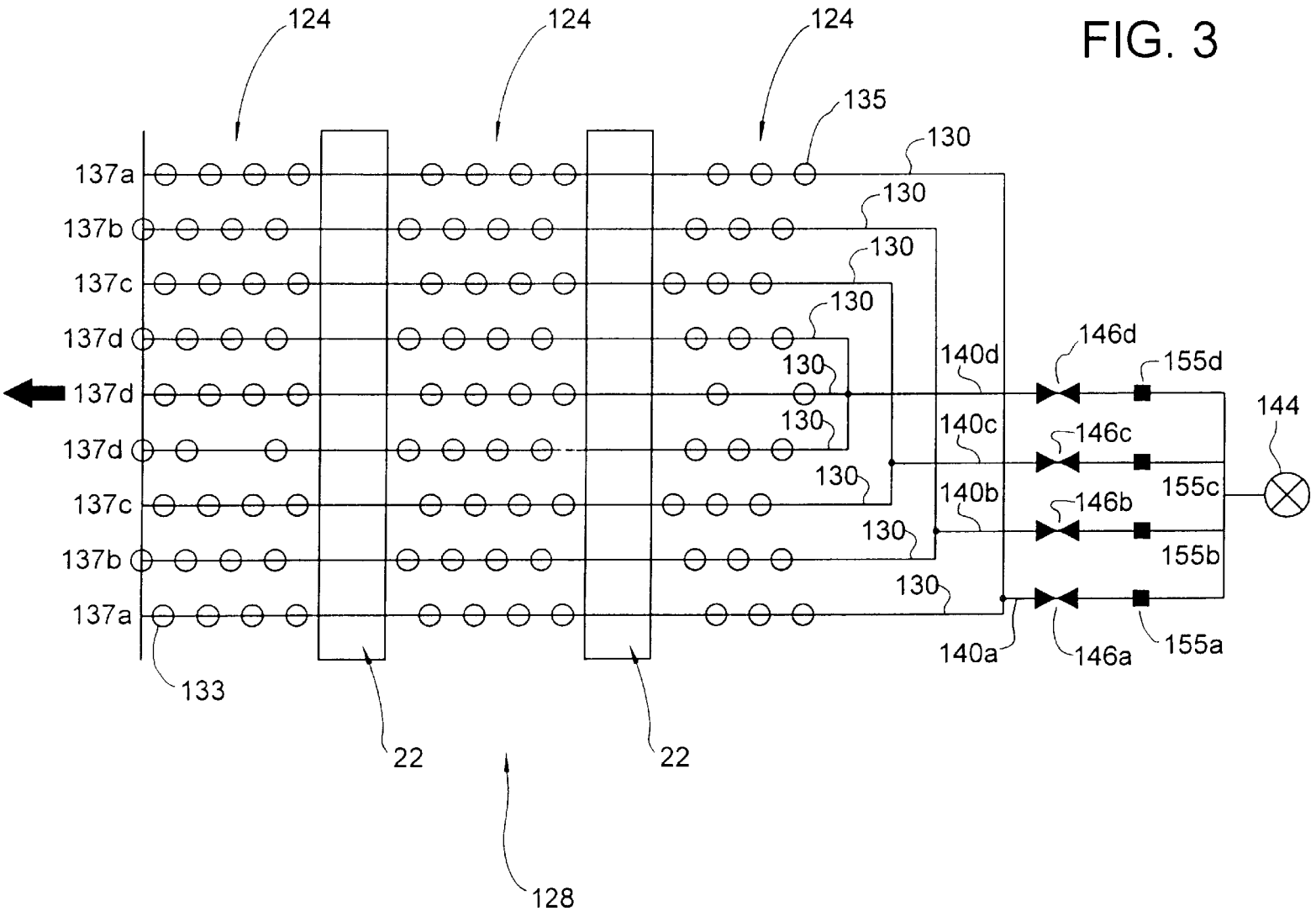
FIG. 3 is schematic plan view of an array of bottom transversely variable spray nozzles suitable for use with the upstream quench station of FIG. 2, and associated fluid supplies thereof.

Top and bottom nozzle clusters 124, 131 are arranged in respective matrix arrays 126, 128 each comprising a plurality of equally spaced longitudinal banks 130 extending in columns parallel to the line. FIG. 3 illustrates this arrangement for bottom nozzle clusters 124; the mirror image of this arrangement would exist for top nozzle clusters 131 arranged in banks 130.

The number of banks 130 chosen to span the transverse width of the line depends on the maximum width of the cast strand. In the illustrated embodiment, there are nine banks of bottom nozzle clusters 124 by way of example.

The maximum number of nozzles 133 in a bank 130 depends on the interior length of the upstream quench station 14. In the embodiment illustrated in FIGS. 1–3, the length of the upstream quench station 14 is limited by the space available between the caster assembly 21 and the severing apparatus 13. An exemplary eleven nozzles 133 are arranged along the length of the upstream quench station 14 for each bank 130. Note that no nozzles 133 are arrayed so as to overlap the conveyor rolls 22; although the rolls 22 constitute a direct impediment to nozzle placement only for the bottom banks 130, the arrangement of the top banks 130 should mirror that of the bottom banks 130 to ensure spray symmetry so that uneven quenching of top and bottom surfaces of strand 12 is avoided or at least mitigated.

The bank of nozzles 130 are grouped into four groups 137*a*, 137*b*, 137*c*, 137*d*. Each group 137*a*, etc. comprises at least two banks 130 equidistant from the longitudinal center of the line. The center group 137*d* additionally includes one central bank 130 overlapping the center of the line. The spray applied to the strand 12 by any group 137*a*, etc. ("spray group") of nozzles 133 is controlled by controlling the flow rate and optionally other usefully controllable characteristics of the sprays (e.g., pressure) of the spray group 137*a*, etc. (such controllable characteristics are collectively referred to as "spray characteristics"). The spray characteristics of any one spray group 137*a*, etc. are controllable separately from the spray characteristics of other spray groups 137*b*, etc. as discussed in detail below. Each spray group 137*a*, 137*b*, 137*c*, 137*d* is supplied water from an associated respective water supply pipe 140*a*, 140*b*, 140*c*, 140*d* connected to and supplied by a water pump 144. Each nozzle 133 is provided with air from an air compressor 142 via suitable air supply lines (omitted from FIG. 3 for purpose of clarity). The air and water are mixed in each nozzle to provide the air mist applied to the strand 12.

Each water supply pipe 140*a*, 140*b*, 140*c*, 140*d* has an associated respective control valve 146*a*, 146*b*, 146*c*, 146*d*, the adjustment of which changes the water flow rate and consequently the air mist flow rate for each spray group 137*a*, 137*b*, 137*c*, 137*d*. Each such valve 146*a*, etc. may be a butterfly valve or any suitable adjustable flow-rate valve. Each water supply pipe 140*a*, 140*b*, 140*c*, 140*d* has an associated respective pressure regulator 155*a*, 155*b*, 155*c*, 155*d* the adjustment of which regulates the water pressure through the associated supply pipes 140. Similar air control valves and air pressure regulators control flow rate and pressure for the air (not shown). The air and water control valves 146 and pressure regulators 155 enable the spray characteristics of the sprays to be differentially controlled transversely across the strand 12. Since the temperature profile of the strand is almost always symmetrical about its centerline, the choice of spray groups 137*a*, etc. to include banks 130 equidistant from the center of the line is appropriate.

Preferably, each spray nozzle cluster 131 , 124 comprises a longitudinally aligned series of individual nozzles 133 each being an internal-mix pneumatic atomizing-type nozzle that mixes water and air for discharging in a flat oval spray pattern. Each nozzle cluster 131, 124 is preferably positioned so that the major axis of the oval spray pattern is transversely oriented, i.e. perpendicular to the line. The transverse width of each spray pattern and the distance between adjacent clusters 124 of nozzles are selected so that there is no gap but preferably minimal overlap between the sprays of the adjacent clusters of nozzles. To this end, the nozzle clusters 124 in alternate columns are offset from one another by a selected amount.

Because slabs or slab-shaped strands tend to cool naturally more quickly around the vicinity of their outer edges than at other parts of the surface, and because air mist sprayed on the longitudinal central portions of the strand tend to migrate towards and contribute to further cooling of the outer edges, transverse differential spray control of the columns or longitudinally aligned banks 130 enables a lower intensity of spray to be applied by the outer banks of nozzles 130 than the inner banks of nozzles 130. The spray characteristics of each spray group 137*a*, 137*b*, 137*c*, 137*d* can be selected in response to this expected temperature profile and the heat-transfer properties of the associated portion of the surface of the strand 12. Thus, by way of example, for quenching a given casting, spray group 137*a* might be idle, spray group 137*b* providing a low flow rate spray, spray group 137*d* providing a considerably higher flow rate spray, and spray group 137*c* providing a spray at a flow rate intermediate that provided by spray groups 137*b* and 137*d*. Suitable selection of flow rate and any other useful spray parameters enables the temperature of all surface portions of the strand 12 to be cooled to nearly the same post-quench temperature.

Masking means such as longitudinal flanges [not shown] can be optionally installed on both longitudinal strand edges to shield the outermost longitudinal edges of the strand from spray, thereby further reducing the amount of cooling effected on the strand edges. The longitudinal flange may be used in conjunction with the tranversely controllable sprays to reduce the amount of edge cooling. Alternatively, suction means [not shown] such as longitudinal suction slots extending along the length of the upstream quench station 14 and at either longitudinal edge of the strand may be used to suction excess cooling fluid collected on the top surface of the strand, thereby preventing overcooling of the edge portions of the strand.

It has been found that it is unnecessary to provide sprays especially to quench the sides of the strand 12 (for a strand to be severed into slabs); the side surfaces tend to cool sufficiently quickly that separate spraying is unnecessary. Further, downstream edging may correct some surface defects in the vicinity of the side surfaces. If there is a risk of overcooling the side edges of the steel, shields or spray masks in the vicinity of the side edges may be optionally provided to impede cooling fluid from reaching the side edges of the steel.

The air compressor 142, water pump 144 control valves 146 and pressure regulators 155 can be manually operated. An operator can determine the appropriate spray characteristics required to apply a suitable quench from temperature profile data of the incoming slab 12, then manually make the appropriate adjustments for each of these pieces of equipment. Preferably, at least some of these steps are automated by conventional means. In this connection and referring to FIG. 4, monitors or sensors for monitoring or measuring the values of selected parameters can be provided. For example, basic supply water pressure and air pressure, line speed, pre-quench surface temperature of the steel across a transverse profile, post-quench surface temperature of the steel across a transverse profile, and spray group flow rates or valve settings could all be monitored or measured. The associated sensors are each electrically connected to and communicative with a control unit 160. For example, sensors 139, 141 for air and water supply respectively transmit data signals associated with air and water pressure respectively to the control unit 160 via data transmission lines 143, 145 respectively. The control unit 160 in response to the received data signals can provide control signals via control signal lines 149, 151 to air pressure regulator 153 and water pressure regulator 155 respectively, to remedy any irregularity in the air and water supplies. Suitable intervening digital/analog converters, relays, solenoids, etc. are not illustrated but would be used as required in accordance with conventional practice. The specific means chosen for the sensing of system parameters and provision of data signals may be per se essentially conventional in character and is not per se part of the present invention.

Figure 4:
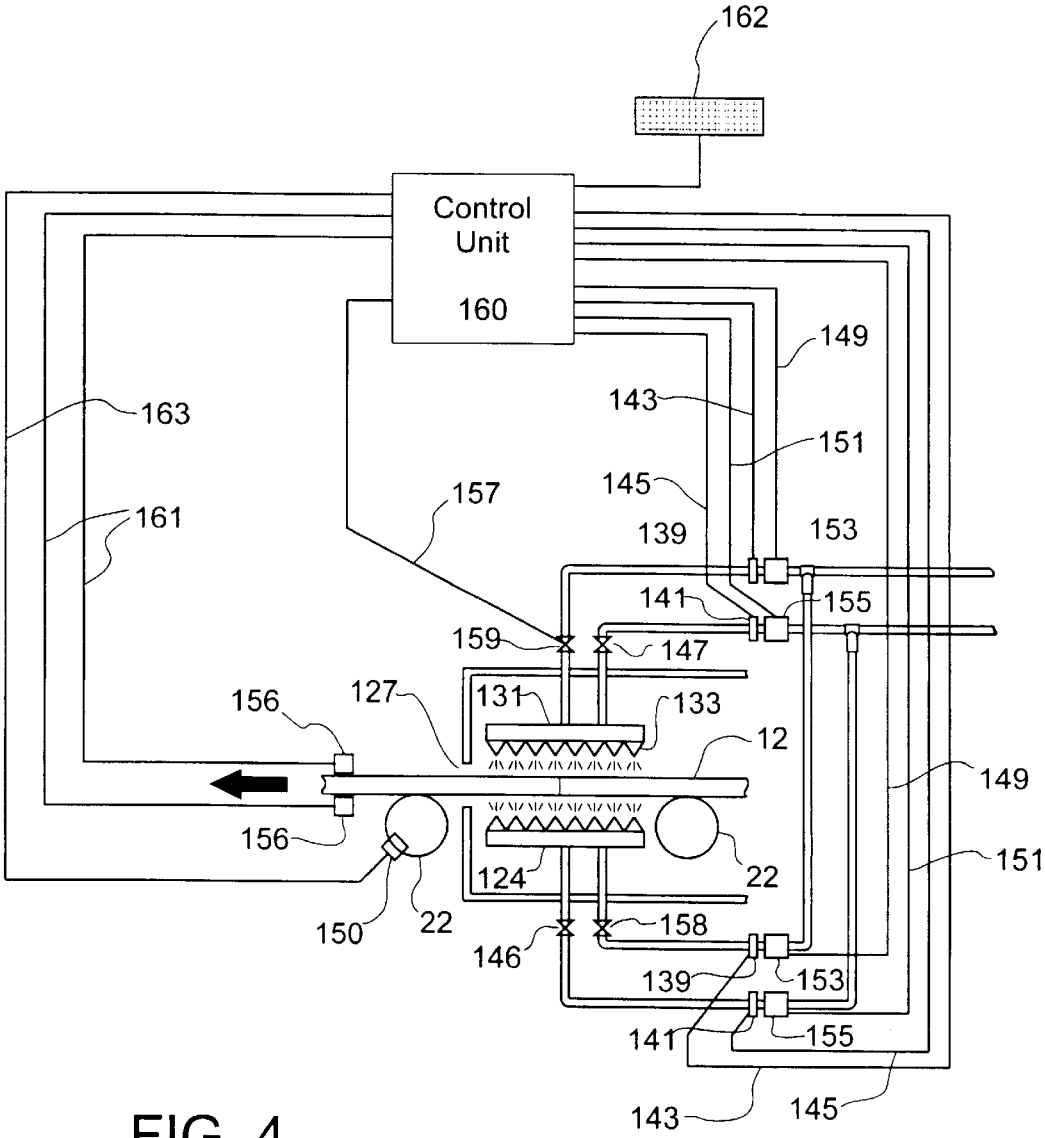
FIG. 4 is a schematic diagram of a control unit for the transmission of air and water to spray nozzles in the array of FIG. 3 shown as a fragmentary group.

Water control valves 146 and 147 control the water flow rate to bottom and top nozzle clusters 124, 131 respectively. Air control valves 158, 159 control the air flow rate to bottom and top nozzle clusters 124, 131 respectively. The air and water valves 146, 147, 158, 159 are similarly connected to and responsive to the control unit 160 which controls the flow rate of air mist through the valves 146, 147 by means of control signals transmitted via respective control signal lines, only one of which, line 157, is illustrated in FIG. 4 in the interest of simplification of the drawing.

Pyrometers 156 may be located downstream of the upstream quench station 14 or located in the vicinity of the quench unit exit port 127 or elsewhere as the designer may prefer, e.g. just upstream of the upstream quench station 14. In FIG. 4, the strand 12 moves in the direction of the arrow (right to left). The pyrometers 156 illustrated are mounted downstream of the upstream quench station above and below the as-quenched strand 12 passing therebetween. While only one block 156 appears above and below the strand 12 in the drawing, it is to be understood that either the pyrometers 156 would be able to scan across the transverse width of the strand 12, or else a transverse array of pyrometers 56 across the width of the strand 12 would be provided. For each of the top and bottom strand surfaces, the pyrometers 156 measure the transverse temperature profile of the respective surface. The pyrometers 156 are electrically connected to and communicative with the control unit 160 and transmit data signals associated with the surface temperature to the control unit 160 via data transmission lines 161 following the strand's passage through the upstream quench station 14. With this data, the control unit 160 can determine whether the as-quenched temperature profile of the strand 12 falls within acceptable parameters; if not, the control program 160 (or the operator, if performed manually) calibrates the quench characteristics settings accordingly for the subsequent portions of the strand to be quenched. Generally, after enough data on castings of various compositions, widths, and casting histories have been accumulated, enough look-up tables for flow-rate settings will have been compiled that recalibration will seldom be necessary. Alternatively, pyrometers may be installed upstream of the upstream quench station 14 to determine the products incoming temperature profile, thereby in conjunction with the downstream pyrometers 156 providing a dynamically responsive control system.

Roll speed tachometers 150 provide conveyor speed data to the control unit 160 via data line 163. One or more tachometers 150 are positioned at one or more selected conveyor rolls 22; in the case of quenching of slabs, such tachometers 150 may be preferably located at both upstream and downstream rolls 22 relative to the severing apparatus 13 so that a measurement of both casting speed and strand conveyor speed (if permitted to be different from casting speed) is obtained. However, for purposes of simplification, only downstream tachometer 150 is illustrated in FIG. 4. The conveyer speed data are used by the control unit 160 to determine the appropriate flow rate to be applied to the strand 12, as described in further detail below.

Similarly, the tachometer 150 may with the control unit 160 be part of a feedback control loop controlling the conveyor roll rotary speed. If line speed is to be made dependent upon quench operation, the conveyor roll drive (not shown) may receive control signals from the control unit 160 that control the rotary speed of the conveyor rolls 22. For example, the control unit 160 may be programmed to change the casting speed under certain circumstances, for example, if the casting speed exceeds the quenching capacity of the upstream quench station 14; in this situation, the control unit 60 would send a control signal to the caster 11 to reduce the speed of the caster 11.

In a preferred embodiment, the control unit 160 is a general purpose digital computer that is electrically connected to and receives data signals from sensed parameters, as exemplified by the various data signal lines from the devices illustrated in FIG. 4. The control unit 160 may have a memory storage device [not separately shown] for storing data, and is operated by a suitable control program. Programming the control program is routine and will take into account the specific objectives to be served in any given rolling mill; such programming is not considered to be per se part of this invention. For example, the control program may conveniently be based in part on conventional dynamic cooling control programs used in other parts of the casting mill, such as known cooling control programs used in the secondary cooling region of the strand containment and straightening apparatus 16.

Analysis indicates that preferred flow rate from a given nozzle, or bank or group of nozzles, is dependent upon casting speed roughly in accordance with the equation $$f=av^2+bv+c$$

where f is the flow rate for any given nozzle, or bank or group of nozzles, a, b and c are constants, and v is casting speed. Obviously the constants a, b, c will be different for a given individual nozzle, a given bank, or a given group. However, reliance should not be placed too highly on the analytical results; empirical approaches are required to determine optimum flow rate choices for nozzle groups.

Because the equation given above for the relationship between flow rate and casting speed includes one term that is proportional to the square of the casting speed, it follows that dramatically increasing flow rates are required as casting speed increases. For example, the flow rate at a casting speed of 60 inches per minute for a 6-inch casting might be roughly three times the flow rate required for the same casting travelling at 30 inches per minute.

The control unit 160 may have user input devices such as a keyboard 162 to enable an operator to input new data or override any of the functions performed by the control program. For example, a test slab may be occasionally removed from the casting line after the strand from which it was cut was quenched and before it enters the reheat furnace. The cross-section of the test slab is then examined to determine (a) whether the steel's microstructure has been transformed by the quench to a suitable depth, and (b) whether the depth is suitably uniform across the transverse width of the slab. If the operator is not satisfied with the quench effected on the test slab, he may reprogram, adjust the weight to be given the parameters used by the quench program, recalibrate and recalculate look-up tables, or manually select the spray characteristics and any other controllable parameters, so that subsequent steel product is quenched to his satisfaction.

Referring to FIGS. 3 and 4, the transverse differential control of the spray nozzles 124 enables the control unit 160 to tailor the transverse width of the sprays to the width of the target strand 12 and to adjust flow rates of the spray groups 137*a*, etc. to fit the surface temperature profile of the strand 12. The control unit 160 receives and processes a data signal identifying the width of the strand, determines the number of spray groups that are required to cover the target surfaces, and sends control signals to the appropriate output control devices (e.g., solenoid valve actuators for the control valves) that will enable or disable the spray groups 137*a*, etc. and adjust their respective flow rates.

The foregoing description has covered steady-state conditions in which the casting speed is constant. However, casting speeds typically vary considerably throughout a casting run. Since whenever the speed begins to change, it is uncertain what new steady-state value of casting speed will be reached, the flow-rate control system has to respond on the basis of an inherent uncertainty as to the new target casting speed expected to be reached after the current transient condition has come to an end. It has been found that potential deceleration-related over-quench problems tend to be more acute than potential acceleration-related under-quench problems, partly because casting-line problems tend to require a fairly steep "ramp down" deceleration that is sometimes as much as three times the rate of "ramp up" acceleration. Accordingly, the requisite decrease in flow rate to avoid over-quenching should be greater when deceleration occurs than the increase in flow rate when acceleration occurs in the casting line. In any given facility, an empirical approach should be taken to determine the optimum value. Monitoring surface temperature of the steel downstream of the quench may facilitate automatic or operator control of the flow rate through the quench nozzles. Typically the downstream surface temperature should be maintained in the range about 538° C. (1000° F.) to about 704 C. (1300° F.). At temperatures above about 1300° F., the quenched layer tends to be insufficiently deep.

The arrangement offering the finest differential control over the spray characteristics of the sprays would include an array of nozzles having a dedicated supply line and control valve for each nozzle. This arrangement is within the scope of the invention but is not preferred, as the high number of individual controls may make the cost of constructing a upstream quench station prohibitive and the control system for the array unduly complex.

The upstream quench station 14 may quench steel that include titanium as an alloying element. In such cases, the relative position of the upstream quench station 14 in the line, its longitudinal dimensions, and the speed of the casting are preferably optimized to permit substantial TiN precipitation so that AlN precipitation is suppressed and solute nitrogen content is reduced. The presence of solute nitrogen tends to reduce ductility in the cast metal. Typically, the steel contains between about 0.015% and 0.040% titanium. Preferably, enough titanium is added to the metal prior to quenching to form a titanium-to-nitrogen weight ratio of the order of 3:1. Quenching to a post-quench surface temperature below about 750° C. to 800° C. yields optimal TiN precipitation, thereby optimally suppressing ALN formation. As a further effect of optimal TiN precipitation, solute nitrogen content is reduced. As a result, undesirable effects caused by AlN precipitation are minimized. Other residual elements may precipitate and/or segregate to grain boundaries as the strand cools prior to being quenched. Any contribution to surface defects by the other residual elements appears to be addressed either by the quench alone, or by some combination of the quench and TiN precipitation. Also, the decrease in ductility resulting from residual element precipitation is at least partially offset by the increase in ductility from the solute nitrogen reduction.

Referring back to FIG. 1, after the strand 12 has been quenched in the upstream quench station 14, the strand 12 exits the upstream quench station 14 and is severed into slabs 18 by the severing apparatus 13. Then, each slab 18 is transferred onto a transfer table 20 that transversely feeds each slab 18 sequentially into a reheat furnace 15, where the quenched portions of the slab 18 are reheated to a uniform temperature at least above $Ac_3$ (about 900 C. for most steels of interest) and re-transformed to austenite. Preferably the slab is reheated to a temperature above $T_{nr}$ and specifically, to a temperature of about 1260° C. to provide a suitably high temperature for controlled rolling, discussed in detail below. It has been found that the austenite formed by this combination of quenching and reheating tends to have a finer grain size than austenite grains of a steel product that has not been quenched before reheating. It has further been found that formation of finer grains of austenite is associated with the reduction in the occurrence of defects in the surface of the eventual steel product. The slabs 18 are held in the reheat furnace 15 for a period of time sufficient to heat the slabs 18 to a uniform temperature for rolling.

After the slab has been suitably quenched and reheated in the reheat furnace 15, each slab 18 is transferred out of the reheat furnace 15 and onto the upstream end of a rolling table 22. The slabs are descaled in a descaler 17, which applies a series of high-pressure water sprays onto the surface of the slab to remove scale. If the weight of a slab exceeds the weight capacity of the coiler furnaces 21, 23, (or some other applicable limiting flow through parameter, to be discussed in detail below) the slab is severed by hot flying shear 25 into a target portion within the coiler furnace weight capacity and a surplus portion. While a hot flying shear is the preferable choice, another severing device capable of severing such slabs may be suitable used. Preferably the target portion is severed after it has been reduced to a thickness within the coiler furnace thickness capacity, but if not, it is then further reduced until its thickness is within the coiler furnace thickness capacity. Then the target portion is coiled in one of coiler furnaces 21, 23 while the surplus portion can be further reduced by the Steckel mill, or immediately sent downstream for further processing.

Figure 7:
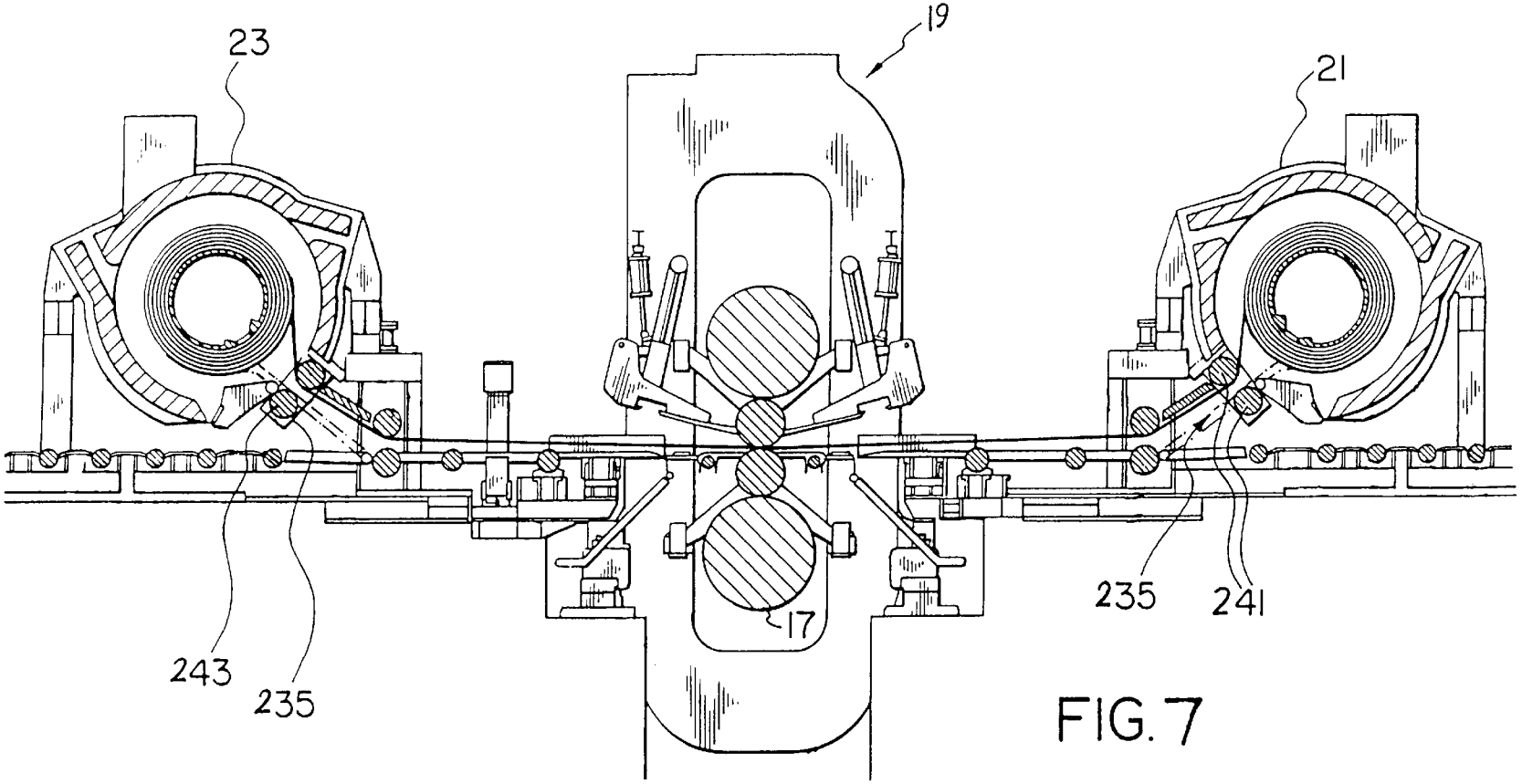
FIG. 7 is a schematic diagram showing in greater detail of a portion of the Steckel mill and associated coiler furnaces of FIG. 1.

Referring to FIG. 7, each slab is then sequentially reversingly rolled in a Steckel mill 19 into an intermediate steel product 26 having a target end-product thickness (i.e. the objective end-thickness to be met) and a recrystallized and pancaked austenitic microstructure. This process is described in detail in U.S. Pat. No. 5,810,951 and is summarized briefly here. In the Steckel mill 19 and during a recrystallization stage, the slab 19 is first flat-passed rolled into an intermediate steel product at a temperature above $T_{nr}$ in order reduce the thickness of the product by a selected amount and to enable some controlled austenite recrystallization in the product. Then, the product is subjected to at least one recrystallization coiler-pass comprising reducing the steel to a thickness within the coiler furnace thickness limitation (say, of the order of about 1"), and coiling and uncoiling the steel product within the coiler furnaces 21, 23. The coiler furnaces 21, 23 are maintained at least about 1,000 C., which is for steel grades of interest, above the $T_{nr}$. The coiler furnaces 21, 23 substantially slow the natural (slow-air) cooling of the coiled product, so that the product remains above $T_{nr}$ for the selected number of recrystallization coiler passes, thereby enabling additional controlled austenite recrystallization of the product.

To provide enough time for recrystallization, the recrystallization stage should preferably be at least about 60 seconds; however, the desired recrystallization period will vary somewhat for different steel chemistries. Typically, there is enough time for the steel product to achieve the desired recrystallization period during normal flat and coiler passing; during the flat passes, the slower speed of the Steckel mill relative to conventional sequential in-line rolling stands affords an opportunity for recrystallization above $T_{nr}$. During the recrystallization coiler passes, the time taken to coil, stop, reverse direction, then uncoil the steel product provides additional time for recrystallization. The rolling sequence above the $T_{nr}$ for this period will achieve a fine-grained austenite structure of the steel undergoing sequential reductions.

Once the steel product 26 has been reduced to an interim thickness and sufficient recrystallization has occurred, the steel product 26 enters a pancaking stage wherein its temperature is permitted to drop below $T_{nr}$ in a controlled manner during a further series of coiler passes through the Steckel mill, during which the fine grain structure achieved is flattened or "pancaked" and consolidated. The coiler passes during the pancaking stage are hereinafter referred to as pancaking coiler passes to distinguish from the recrystallization coiler passes. Over the period of time taken by a predetermined series of pancaking coiler passes, the temperature is permitted to drop from the $T_{nr}$ to the $Ar_3$ at which time the steel product 26 should have reached its target end-product thickness. Although a reduction of as much as 75% between the $T_{nr}$ and the $Ar_3$ can be tolerated, it is preferred that the end-product thickness be about one-half the thickness of the first-rolled thickness of the intermediate steel product at the time it begins to drop below the $T_{nr}$. In other words, the "pancaking" rolling between the $T_{nr}$ and the $Ar_3$ would preferably result in a 2:1 reduction from the first-rolled thickness of the intermediate steel product to the end-product thickness.

In certain situations, it may be desired to slow down the rate of natural slow-air cooling of the steel product during the pancaking stage, e.g. if it will be difficult to achieve the desired reductions during this stage before the product falls below temperature $Ar_3$. To this end, auxiliary heaters may be installed at appropriate locations around the Steckel mill, such as an induction furnace [not shown] in a space between the Steckel mill and pinch rolls of the coiler furnace.

In addition to facilitating the metallurgical treatment described above, the heat from the coiler furnace 21, 23 tends to equalize any temperature variation that may have developed along the product's surfaces. The time taken to coil, reverse direction and uncoil the product typically provides enough time to equalize temperature variations found in steels typically processed in the Steckel mill 19. Should the product exhibit extraordinarily large temperature variations, the product may be held in the coiler furnace 21, 23 for a deliberate pause period to provide additional time for temperature equalization to occur. Such temperature equalization is important for avoiding the development of inconsistent metallurgical properties after the product is quenched.

The pause periods, if carried out when the steel is above $T_{nr}$ also provide additional time for desirable austenite recrystallization. In this connection, such austenite recrystallization pause periods may be carried out during flat passing. However, the pause periods also provide additional time for precipitates to come out of the steel, which adversely affects the quality of the end-product. Therefore, an operator when selecting the number and length of each pause period, if any, will take into consideration these competing interests, and may affect the precipitation problem somewhat by confining the occurrences of the pause periods to passes at higher temperatures during the recrystallization period.

Preferred metallurgical practice dictates that the overall reduction in the rolling mill should be at least about 3:1. Accordingly, if the reduction imparted below the $T_{nr}$ is about 2:1 (i.e. from the interim-rolled thickness to the end-target thickness), then it follows that the reduction above the $T_{nr}$ should be at least about 1.5:1 (i.e. from a initial slab thickness to the interim-rolled thickness). The amount of reduction, of course, will depend in large measure upon the ratio of the end-product thickness (determined by the customer's order) and the initial slab thickness (typically fixed for a given rolling mill). If, for example, the end-product thickness is to be 0.5", then preferably the intermediate steel product 26 is rolled from a interim-rolled thickness of about 1.0" to a thickness of 0.5" below, the $T_{nr}$ to reach a rolling completion temperature of about the $Ar_3$. If the initial slab thickness is 6", it follows that a 6:1 reduction must occur above the $T_{nr}$ in order to generate an intermediate product of interim-rolled thickness of 1.0" that can be rolled between the Tand the $Ar_3$ to the desired 0.5" end-product thickness.

Coiler furnaces based on present technology can typically coil steel slabs having thicknesses up to 1.0", although in some cases, steel product having thicknesses of up to 1¼" may be coiled. Given that the desired reduction from the interim-rolled thickness to the end-product thickness is 2:1 (in the pancaking stage where the product temperature is between $T_{nr}$ and $Ar_3$), it follows then that the maximum end-product thickness that can be obtained is 0.5". To obtain steel products with a thicker end-product thickness, during the recrystallization stage, the product is subjected to flat pass rolling only, i.e. without any recrystallization coiler passes, at a reduction rate that achieves the desired interim reduction while the steel product is above $T_{nr}$. For example, if an end-product thickness of 0.75" is desired, a 2:1 reduction requires the interim-rolled thickness to be around 1.5". As the product enters into the pancaking stage, i.e. falls below $T_{nr}$, the product is further flat-passed until it reaches the target end-product thickness. Should the end-product thickness be within the coiler furnace thickness limitation, it is possible to subject the product to at least one coiler pass.

To increase the rate of steel processing, an optional optimization method may be performed that involves processing a maximum weight slab through the rolling mill. This maximum weight slab exceeds the capacity of one of the rolling mill apparatuses but is within the maximum capacity of the reheat furnace 15. Typically for producing coiled plate, the limiting flow-through parameter is the weight capacity of the coiler furnace 21, 23; typically for producing strip, it is the strip downcoiler 29. For example, if the weight of a maximum weight slab exceeds the weight capacity of the coiler furnaces 21, 23, (or some other applicable limiting flow through parameter, to be discussed in detail below) the slab is severed by hot flying shear 25 into a target portion within the coiler furnace weight capacity and a surplus portion. Preferably the target portion is severed after it has been reduced to a coilable thickness, but if not, it is then further reduced until its thickness is within a coilable thickness. Then the target portion can be coiled in one of coiler furnaces 21, 23 while the surplus portion can be further reduced by the Steckel mill, or immediately sent downstream for further processing. This optimization method is discussed in detail in U.S. Pat. No. 5,706,688 and is briefly summarized below.

The weight of the maximum-weight slab to be rolled is typically limited by the maximum dimensions of the slab that can be reheated in the reheat furnace 15, which can typically handle slabs of 6" thickness, 120" width, and 75' length. Such slabs of maximum dimensions weigh approximately 92 tons. While the Steckel mill 19 can be built to be capable of rolling such maximum weight slabs, the weight capacity of the coiler furnaces 21, 23 is typically exceeded. Therefore, the maximum weight slab is severed into portions prior to coiling in the coiler furnace 21, 23, wherein the weight of the portion to be coiled (the target portion) is within the coiler furnace weight capacity.

By positioning the flying shear 25 between the Steckel mill 19 and the controlled cooling station 27, specifically, by positioning the flying shear 25 closely downstream of the downstream coiler furnace 23, a maximum-weight slab can be rolled by the Steckel mill 19 at a temperature around $T_{nr}$, then be severed by the flying shear 25 into the target portion and a surplus portion prior to coiling in the coiler furnace 21, 23. Because the steel can be above $T_{nr}$ when severed, a hot flying shear is preferred.

For producing plate, the maximum-weight slab is preferably reduction rolled to below the coiler furnace thickness capacity before it is severed by the flying shear 25. The target portion is then coiled by one of the coiler furnaces 21, 23, and kept above $T_{nr}$ in accordance with the previously described steps of the method. The surplus portion is then further reversingly rolled in the Steckel mill 19 to reduce its thickness to a desired end-product thickness, or is transferred immediately for downstream finishing.

The target portion is held in the coiler furnace 21, 23 for a selected period to enable substantial austenite recrystallization and temperature equalization, uncoiled, then is processed according to the method described above.

Figure 5:
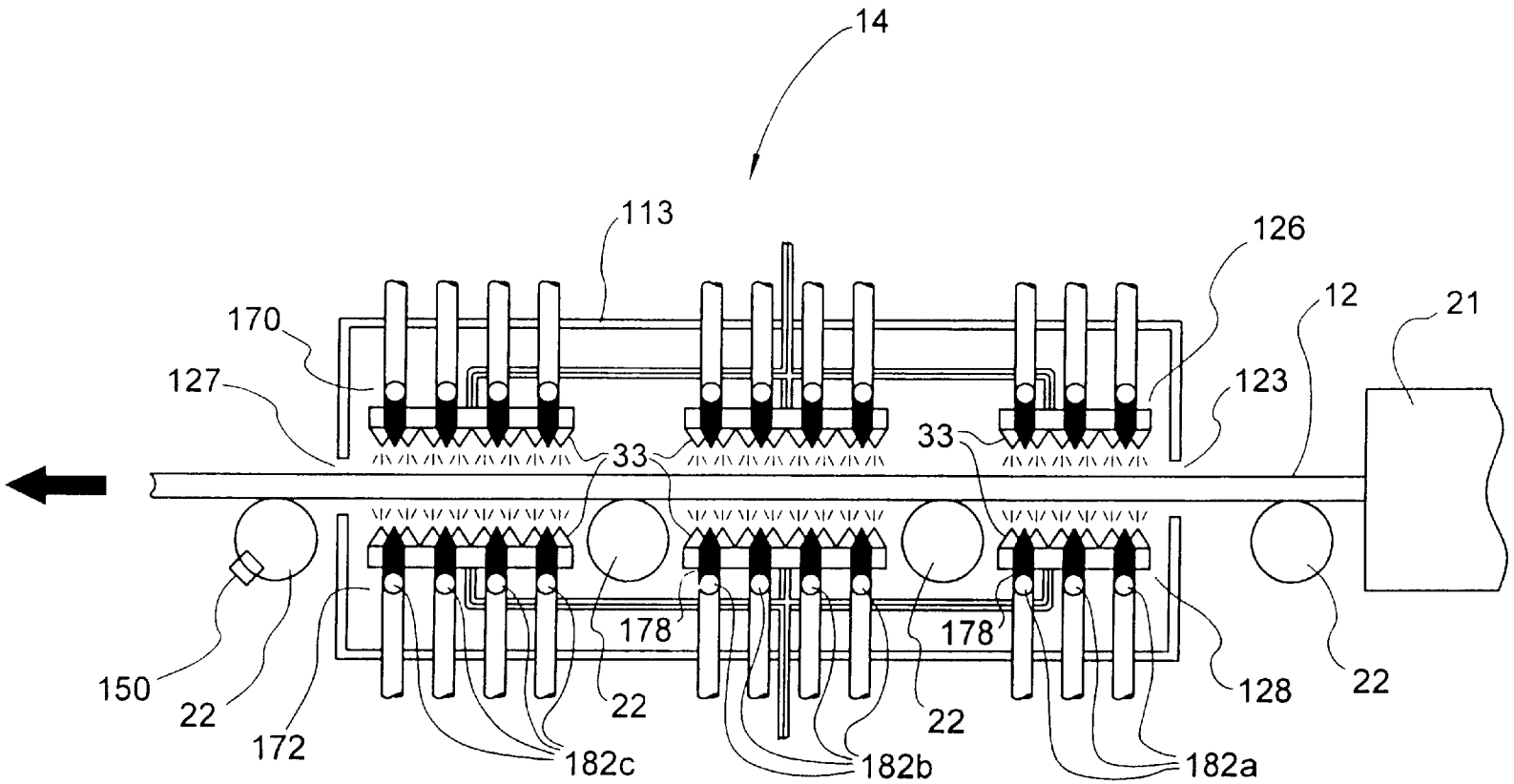
FIG. 5 is schematic interior elevation view of top and bottom groups of spray nozzles within an upstream quench station according to an embodiment of the invention that provides both transverse and longitudinal adjustment of flow rate of cooling fluid from the nozzles.

In order for the surplus portion to be reversingly rolled in the above manner, the target portion that is temporarily stored within one of the coiler furnaces 21, 23 cannot protrude outside the mouth of the coiler furnace 21, 23 to an extent that would cause interference with the surplus portion during rolling. Referring to FIG. 5, the use of an auxiliary set of pinch rolls 241, 243 within the mouth each of the coiler furnaces 21, 23, as proposed in the Smith U.S. Pat. No. 5,637,249, facilitates the retraction of the intermediate product within the coiler furnace 21, 23 to an extent much greater than was previously possible using a conventional coiler furnace, and consequently the use of such auxiliary pinch rolls may be necessary or highly desirable in order that the foregoing alternative mode of operation be practised to advantage. Obviously, the foregoing procedure cannot be practised it the tongue of steel sheet hanging out of the coiler furnace mouth 235 is in the path of travel of the residual portion of the steel being flat-passed within the Steckel mill.

Figure 10:
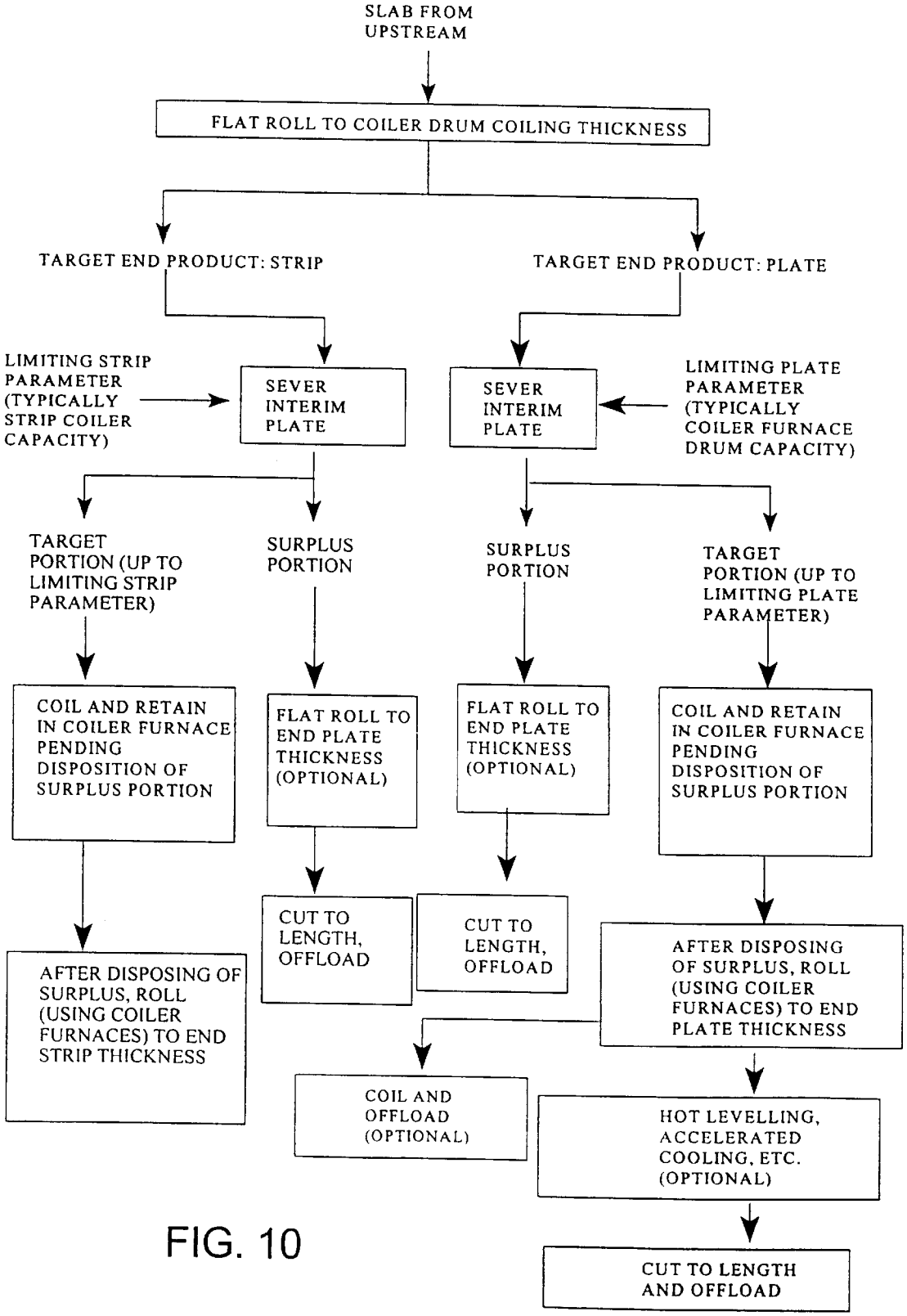
FIG. 10 is a flowchart indicating a preferred sequence of operations for optimizing the efficiency of a rolling mill in accordance with the principles of the present invention.

The objective of obtaining a final high-quality plate product by means of an economical sequence of steps in a mill provided with a cost-effective selection of equipment is satisfied by the present invention. The plate flow-through capacity is typically determined by the coiler furnace weight capacity. However, according to another aspect of the invention, at least part of the slab may be reduced to strip thickness for coiling on a downcoiler 29. This is illustrated in the left column of the flowchart in FIG. 10. The slab is reduced to a thickness not exceeding the coiler furnace thickness capacity, it is severed into a target portion of a weight not exceeding the strip downcoiler weight capacity, and a surplus portion. The surplus portion may be sent immediately downstream to be further processed as a flat plate product, or alternatively, the surplus portion may be further reduction rolled while the target portion yet to be rolled is held in the coiler furnace (assuming the target portion thickness is less than the coiler furnace thickness capacity).

As a further alternative, one or both of the severed slab portions could be made into coiled plate product.

If desired, the benefit of processing a maximum weight slab may be obtained independently of other advantages described in this method. For example, a maximum weight slab may be severed into target and surplus portions wherein the target portion is coiled in a downcoiler as coiled plate and the surplus portion is sent directly downstream for finishing. In this case, the surplus portion is not necessarily subjected to controlled cooling, in order that the target portion be further processed as quickly as possible. In such case, the surplus portion will not obtain optimal bainite microstructure. However, the benefit of increased flow-through capacity is still achieved.

Referring back to FIG. 1, once the product 26 has been suitably reduced in the Steckel mill, its leading end is cut off by hot flying shear 25. The leading end is preferably cut into an precise vertical and clean transverse face. This facilitates even cooling of the top and bottom surfaces of the product when it is subjected to downstream forced cooling (described in detail below). An unevenly cut face will result in one of the top and bottom surfaces being cooled before the other thereby causing uneven cooling between the two surfaces. If allowed to persist, such uneven cooling tends to cause the steel to buckle. The flying shear 25 (itself of conventional design) has been found to be capable of cutting a suitably precise and clean vertical transverse face so that such buckling is avoided.

The flying shear 25 may also be used to cut the product 26 to length (as separate from cutting the product to a target and surplus portion according to the optimization method). Once cut, the upstream product portion is accelerated away from the downstream portion to create a suitable distance between the two portions. In some cases, such speed changes may cause longitudinal temperature variations along the steel product when it is subjected to forced cooling in the temperature reduction facility described in detail below. Such temperature variations if sufficiently severe tend to result in an inferior end product having inconsistent metallurgical and physical properties.

To avoid the onset of unacceptable longitudinal temperature variations, the location of the temperature reduction station can be extended further downstream to allow the product to reach a steady speed before being forcibly cooled; however, such lengthening is usually expensive and impractical given the limited space in the mill and is inconsistent with the objective of maintaining a suitably hot product for quenching. Alternatively, cutting to length may be effected by a separate flying shear ("downstream flying shear") located downstream from the temperature reduction facility [not shown]. However, a second flying shear will also be costly. Therefore, the product may be cut to length by the upstream flying shear and a certain amount of temperature variation may be tolerated; in this connection the operator will be mindful to keep the acceleration of the leading portion to a minimum.

After the product is cut by the flying shear 26, the as-rolled steel product enters a temperature reduction facility 27, 28 wherein it is forcibly cooled. The temperature reduction facility comprises a roller pressure quench unit 28 ("downstream quench station") and a controlled cooling station 27. The type of forced cooling effected will depend on the type of steel selected for production. In this embodiment, two types are steel may be produced, each of which are subjected to different forced cooling: for martensite-rich steels, the product is quenched in the downstream quench station 28 and controlled cooling station 27 then tempered in a tempering furnace; for bainite-rich steels, the downstream quench station 28 is de-activated and the product is cooled in the controlled cooling station 27 only.

Figure 8:
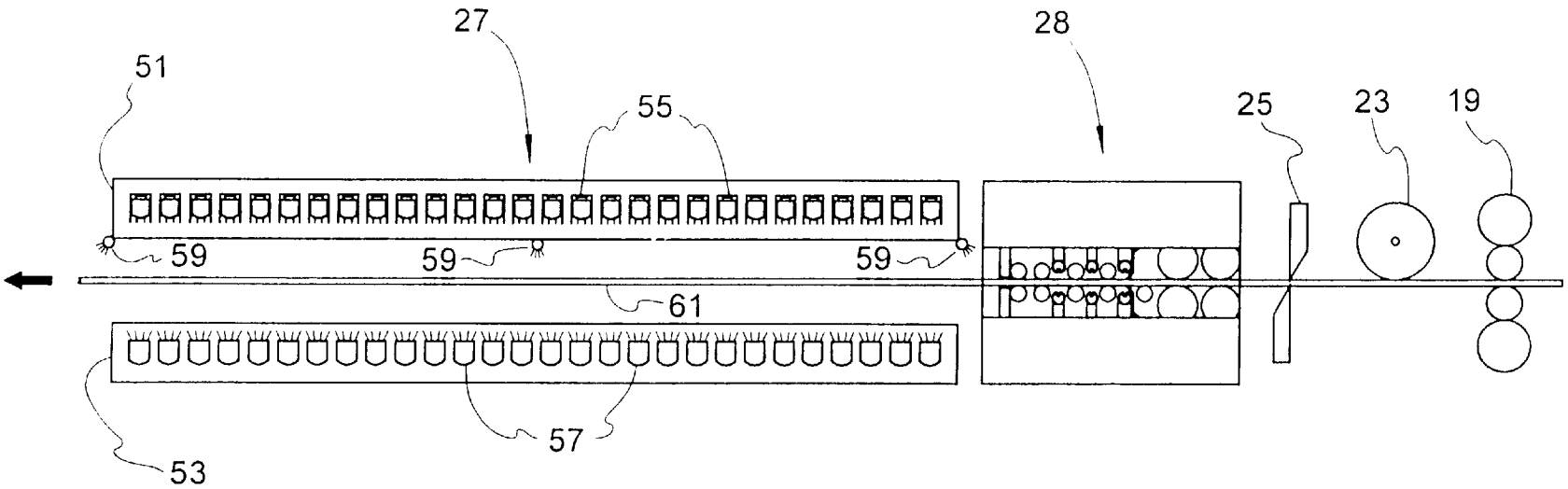
FIG. 8 is a schematic diagram showing in detail the Steckel Mill, flying shear, downstream quench station, and controlled cooling station of the rolling mill in FIG. 1.
Figure 9:
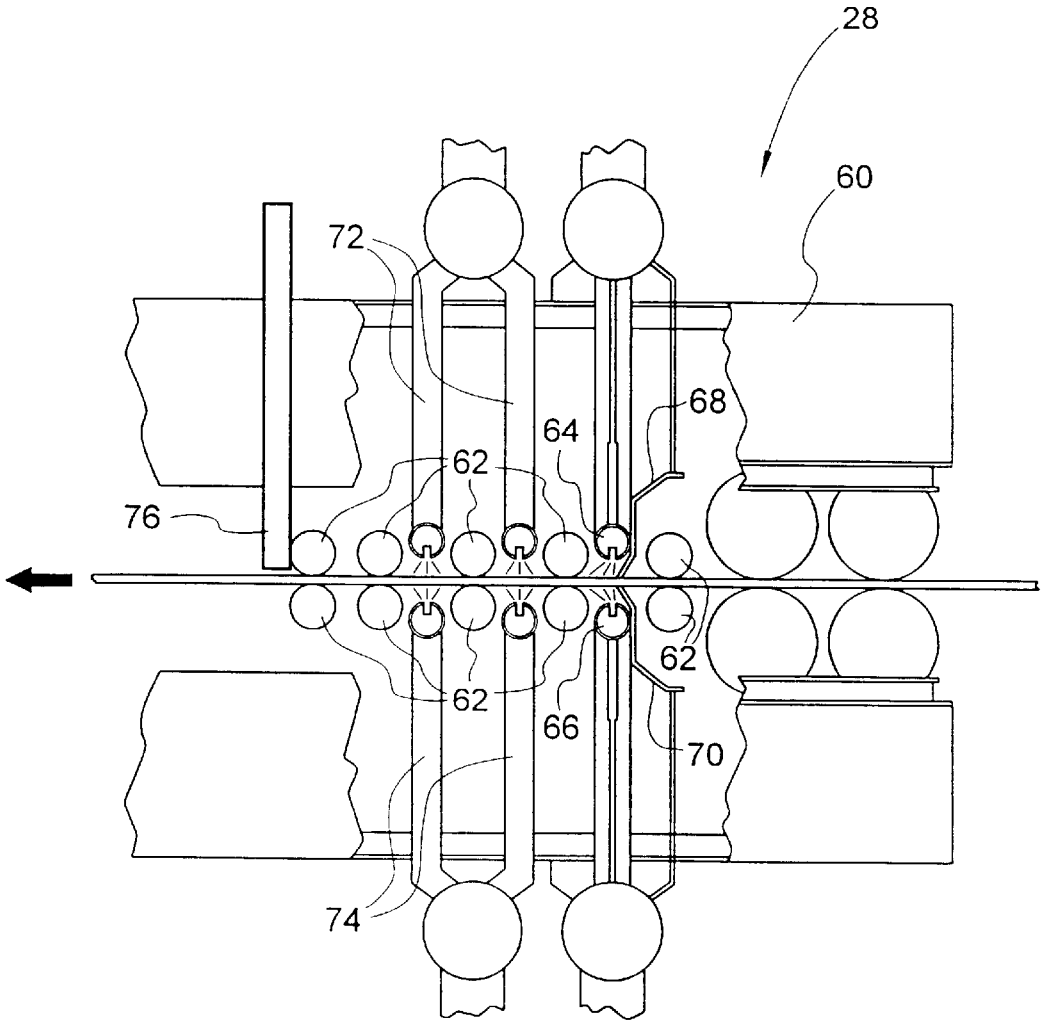
FIG. 9 is a schematic diagram showing in greater detail of a portion of the downstream quench station of FIG. 1.

To produce quenched and tempered steels, the product is fed into the downstream quench station 28 for quenching. The preferred minimum quench start temperature of the product is $Ar_3$; as discussed above, the rolling schedule is selected so that the as-rolled product is a suitably high temperature for quenching. Referring to FIGS. 8 and 9, the downstream quench station 28 is a roller pressure type quench (RPQ) unit that within its housing 60 includes a plurality of tightly-spaced rollers 62 arranged above and below the product passing in-between. The rollers 62 feed the product through the downstream quench station 28 and apply a constraining force above and below the product. There is inside the downstream quench station 28 near the quench apparatus entrance end, opposed upper and lower headers 64, 66 arranged above and below the product passing in-between. The headers 64, 66 are aligned transversely to the rolling direction and emit a transverse uniform sheet of high velocity cooling water onto the upper and lower surfaces of the intermediate steel product, respectively.

The sheet of water emitted by each header 64, 66 is deflected by a respective deflector 68, 70 at an angle that prevents water from spitting upstream of the plate thereby causing pre-cooling. It has been found that an angle of about 22 degrees to the vertical in the direction of travel of the product provides suitable deflection. The tips of the headers 64, 66 are about ⅝ "from the top and bottom surfaces of the product passing in-between. The headers 64, 66 are carefully aligned so that the leading upper and lower edge of the steel are simultaneously struck by the water emitted from the headers 64, 66. This provides even and uniform cooling to the upper and lower surfaces and in conjunction with the constraining force provided by the rollers 62, reduces the risk of the product buckling. Additional quench water is delivered to the upper and lower surfaces by a series of upper and lower downstream headers 72, 74.

The features of the downstream quench station discussed above are conventional and available in commercial quench units, such as the roller pressure continuous high intensity quench units designed and manufactured by Drever Company ("Drever RPQ unit").

The accumulation of water on the top product surface tends to cause non-uniform quenching of the top product surface relative to the bottom product surface. Severe non-uniform quenching may cause the steel to buckle or produce inconsistent as-quenched properties between the top and bottom surfaces. To avoid this, a suction device 76 may be installed immediately downstream of headers 72, 74 or elsewhere above the top product surface where space permits. The suction device has a transversely-aligned slot spanning the width of the maximum width product and uniformly suctions water off the product passing underneath. To facilitate uniform suction, the slot may comprise of a plurality of sub-slots closely spaced in a transverse row.

Each of rollers 62 may be separately driven by associated roller drives [not shown], similar to the arrangement in conventional hot levellers. This provides independent speed control to each individual roller 62 (or at least two separate sets of rollers driven by two separate roller drives). The rollers 62 may be operated at slightly different Speeds to create a lengthwise tension to the product 26 passing through. Such tension has been found to contribute to improved product flatness, and possibly, to improved surface properties.

In operation, cooling water is discharged through the headers 64, 66 at a rate and pressure sufficient to reduce the temperature of the respective surfaces of the steel product below the martensite transformation start temperature $M_s$ and to effect a surface cooling rate exceeding the martensite critical cooling rate, thereby transforming the upper and lower surface layers of the steel product to martensite. The depth of transformation will vary from product to product depending on a number of factors including, the thickness of the product, the cooling rate, pressure, and cooling fluid temperature. The Drever RPQ unit is operable to deliver a quench at 100 psi and 3500 gal/min of cooling water. This quench has been found to generate an initial surface layer of martensite of around 0.25" deep.

After exiting the downstream quench station 28, the product's upper and lower surface layers have been cooled to about the temperature of the cooling fluid; however the product core remains relatively hot, typically at or exceeding $Ar_3$. The product 26 is then fed through the controlled cooling station 27, wherein it is subjected to further cooling directed at keeping the product surface at a chilled temperature. This creates and maintains a maximum temperature gradient that enables maximum heat dissipation out of the product core, as well as impedes the tendency for heat from the core to temper the surface layers. By so cooling the steel at its maximum heat transfer rate, a high proportion of martensite is obtained in the end product.

The controlled cooling station 27 includes an upper array 51 of laminar flow cooling devices that provide cooling water to the upper surface of the intermediate steel product 61 passing underneath the upper array 51. At the same time, a lower array 53 of spray cooling devices provide a cooling spray to the undersurface of the intermediate steel product 61 passing above the array 53. The upper array 51 comprises a longitudinally arranged series of cooling nozzle groups or banks 55. The lower array 53 comprises a series of spray headers 57. The headers 57 are themselves longitudinally spaced from one another and interposed between a longitudinal series of transversely extending table rolls [not shown] that support and drive the product. A suitable such controlled cooling station 27 is discussed in detail in U.S. Pat. No. 5,810,951.

Preferably, for all portions of the product, the heat dissipation rate exceeds the critical martensite quench rate and the finish temperature is below the martensite start temperature, so that the entire product is transformed into martensite. However, since the amount and rate of heat dissipation depends on many factors, including the inherent heat transfer characteristics of the steel, and the steel's chemistry and dimensions, not every portion of the product microstructure may necessarily be transformed into martensite. An operator will consider these factors in relation to the capability of the downstream quench station 26 and controlled cooling station 27 to ensure that the end-product will be sufficiently transformed so that it falls within the applicable quench and temper specifications for the steel end-product. Such specifications may be, for example, ASTM 514 or ASTM 514M.

After cooling in the controlled cooling station, the as-quenched product should have been cooled to about the cooling fluid temperature (typically about 90° F.) on the surface and 200° F. in the core.

Referring back to FIG. 1, after leaving the controlled cooling station 27, the product is either downcoiled on a downcoiler 29 if the steel is to be eventually processed into strip end product, or passed further downstream for further processing as an eventual plate product. The remaining discussion relates to the production of plate product.

The product may be optionally levelled in a hot leveller 31. Then, the product is transferred to a transfer table 33 and thence transversely to a cooling bed 35. Then, the steel is taken off-line and transferred into a tempering furnace 37 where it is held for a suitable tempering period at a suitable tempering temperature. Tempering effects a useful amount of ductility to the product, without which the as-quenched product would be undesirably brittle. The tempering temperature is selected to be below a lower critical transformation temperature $Ac_1$ being the lower temperature limit above which austenite transforms into austenite. The tempering effects a controlled diffusion of entrapped carbon from the martensite to restore some ductility to the product. Suitable such tempering furnaces are commercially available and not per se part of the invention.

After tempering, the product has extremely high strength and other properties characteristic of quench and tempered steels. The product is then transferred to a plate finishing line, which typically includes a static shear 39 for cutting heavier plate product to length, a cold-leveller station 41 for further levelling, and a flying shear 43 for cutting or trimming lighter plate product to length. After finishing, the finished plate product may be piled in piles 49, or put onto transfer tables 47 for shipping.

For processing non-quench and tempered steel, the forced cooling downstream of the Steckel mill is directed towards obtaining a product with a predominantly bainitic microstructure; such a product tends to exhibit enhanced strength and toughness. To produce such product, the roller-pressure downstream quench station 28 is deactivated and the as-rolled product 26 is fed through the downstream quench station 28 without quenching and into an operational controlled cooling station 27. The product 26 will have slow air cooled somewhat by the time the it reaches the controlled cooling station 27, but it is still relatively hot, in the order of about the $Ar_3$, and therefore has a predominately austenitic microstructure. In the controlled cooling station 27, the product surface is cooled at a rate of about 12 C. to about 20 C. per second and to a temperature of about 200 C. to about 350 C. below $Ar_3$. This cooling transforms most of the austenite into fine-grained bainite so that the product has a predominantly bainitic microstructure relatively free of martensite, which in conjunction with the austenite recrystallization and pancaking effected during rolling, provides the steel with enhanced strength and toughness. This method is described in detail in patent and U.S. Pat. No. 5,810,951.

After cooling in the controlled cooling station 27, the product is further processed and finished in a manner substantially similar to the processing and finishing of quench and tempered steel described above.

EXAMPLE

An exemplary application of the invention to process ½ "80,000 PSI yield-strength steel plate begins with a 6" slab of the following chemistry:

| | |
|---|---|
| carbon | 0.03 to 0.05% |
| manganese | 1.40 to 1.60% |
| sulphur | 0.005% max |
| phosphorus | 0.015% max |
| silicon | 0.20 to 0.25% |
| copper | 0.45% max |
| chromium | 0.12% max |
| columbium (niobium) | 0.02 to 0.06% |
| molybdenum | 0.18 to 0.22% |
| tin | 0.03% |
| aluminum | 0.02 to 0.04% |
| titanium | 0.018 to 0.020% |
| nitrogen | 0.010% max |
| vanadium | up to 0.08% |

Consider the above 6 inch thick steel casting having a variable width of anywhere between about 40 inches and 125 inches, being produced at normal casting line speeds of anywhere between about 30 inches per minute and 75 inches per minute. Assume that a quench penetration of at least about a half-inch from the surface is targeted, and that the quench will reduce surface temperature of the casting from a temperature of the order of 982 C. (1800° F.) to a temperature of the order of 538–704 C. (1000–1300° F.)

Engineering considerations, notably the principle of simplification, make it desirable to control nozzles in banks of longitudinally aligned nozzles. Four groups of top nozzle banks can be arrayed over the maximum width of the casting, including:

first, a central group of at least 1, and perhaps 3 or 5 banks of nozzles;

second, a mid-inner group comprising, say, 4 banks of nozzles, two on either side of the centre line and lying outside the central group;

third, a mid-outer group of nozzles comprising, say, 4 nozzle banks, two on either side of the centre line and outside the mid-inner group; and fourth, a final outermost group of nozzles comprising, say, 4 banks, two on either side of the centre line, and the outermost bank of which on each side of the centre line overlaps the edge margin of the casting of maximum width, or may be inset slightly from the edge of the casting.

A counterpart four groups of bottom nozzle banks can be arrayed under the casting in a comparable manner. Note that the maximum number of nozzle banks in the foregoing example exceeds the number illustrated in FIG. 3.

With a nozzle array and nozzle bank selection of the foregoing sort, it may be useful to operate all four groups of top and bottom nozzles only when the casting being produced is of maximum width, or up to about, say, 90% of maximum width. For castings of, say, 75–90% of maximum width, the outermost group of nozzles would be idled. For castings of about 55–75% of maximum width, the outermost group and the mid-outer group of nozzles could be idled. For castings of about 35–55% of maximum width, all nozzle groups except the central group could be idled.

Conveniently, the bottom nozzles underneath the casting may correspond on a one-to-one basis with the top nozzles above the casting. The groups of bottom nozzles can operate at flow rates that may conveniently be set at a specified multiple of the flow rates of the corresponding groups of top nozzles. It has been found that the flow rate for the bottom nozzles should be preferably from about 1.2 to about 1.5 times the flow rate for the top nozzles located above the casting. The reason for the difference, of course, is that water or other cooling fluid is assisted by gravity to cool the top of the casting, but water quickly falls away from the bottom surface of the casting.

It may be desired to set the flow rates for the different groups of nozzles at specified fractions of the central group. The fraction chosen will depend upon how many groups there are altogether, and whether particular groups are operating, or idle. It has been found effective to have the outermost nozzle groups provide flow rates that can be as little as about ¼" the flow rate of the central nozzle group, with the fractions for nozzle groups between the outermost group and the central group progressively increasing in relative flow rate as one progresses from the transverse edge of the nozzle array toward the central nozzle group (which coincides with the central portion of the casting being sprayed). For example, the mid-inner nozzle group next to the central group might be operated at about 50 to 75% of the flow rate of the central group of nozzles. Different ratios may be chosen for the top and bottom arrays of nozzles respectively, but generally similar ratios have in practice proven to be satisfactory for a given top nozzle group and its counterpart underneath the casting, relative to the central nozzle group in the two cases.

It has also been found that if nozzle groups are selected as indicated above, and idled selectively as indicated above, it may be possible to have all three nozzle groups other than the central nozzle group operate at a single specified fraction of the flow rate of the central nozzle group, the fraction preferably being in the range about 50–75% of the flow rate provided by the central nozzle group. Transverse control of flow rate in this mode of operation is effected by selectively idling one or more groups of nozzles.

Values chosen for flow rates, selection of nozzle groups to remain idle, and other operating parameters may be expected to vary depending upon steel grade. For most commercial grades of steel plate cast from a 6" mold, a quench penetration into the casting of about ½" is satisfactory. The total flow required will vary considerably with casting width; for narrower castings of up to about 65", it may be possible to achieve quite satisfactory quenching with only the central nozzle groups (top and bottom) operating. For maximum-width castings of, say, 125", all nozzle groups should operate for at least moderate casting line speeds (say 30"/min and over). At a casting line speed of 30"/min, the top central nozzle group of three longitudinal banks of nozzles might provide a flow rate of about 120 gal/min; at 60"/min, that same group might provide a flow rate of about three times the flow rate set for 30"/min. The actual choices of setting of flow rate per nozzle group are best determined empirically for each speed, for each casting width, and for each grade of steel being produced. A set of look-up tables may be compiled based on the empirical data and used as input to the computer for controlling nozzle groups or used by the mill operator to set flow rates, or in unusual or experimental circumstances to override the computer where this is considered desirable. Computer control of solenoids or relays or the like for controlling butterfly valves or other suitable valves for individual nozzles or groups of nozzles is known pet se and not per se part of the present invention. If desired, appropriate instrumentation, such as pyrometers, may be located at the quench unit 14 entrance and used to construct a temperature profile model of the incoming steel product. This model would be updatable with fresh date from the instrumentation and would be utilized by the control unit 160 to dynamically control the operation of the quench.

For automatic control of the quench, the quench control program may be alternatively developed from known cooling control models, such as those developed by Richard A. Hardin and Christoph Beckermann from the University of Iowa, or I. V. Samarasekera et al. from the University of British Columbia. The programming of the control program from such known control models or known cooling control programs is routine.

After quenching, the slab is sent to a reheat furnace wherein it is heated to a uniform rolling temperature of preferably above or about 1,260 C.

The slab is then sent to the Steckel mill for reverse rolling according to the following rolling schedule:

| | Temperature | Thickness |
|---|---|---|
| Slab Dropout | 1,260 C. | 6.0" (152.4 mm) |
| | 1,230 C. | 4.7" (119.4 mm) |
| | 1,200 C. | 3.5" (88.9 mm) |
| | 1,165 C. | 2.4" (61.0 mm) |
| | 1,100 C. | 1.6" (40.6 mm) |
| | 1,050 C. | 1.0" (25.4 mm) |
| $T_{nr}$ (Non-Recrys.) | 970 C. | COIL in Coiler Furnace |
| | 950 C. | 0.76" (19.0 mm) |
| | 875 C. | 0.61" (15.5 mm) |
| | 800 C. | 0.50" (12.7 mm) |
| $Ar_3$ (Upper Critical) | 800 C. | 0.50" (12.7 mm) |

In the above table, for steel of the chemistry indicated, the $T_{nr}$ is approximately 970 C. During the recrystallization stage, the steel product is reduced by a series of flat passes according to the above rolling schedule from the reheat furnace dropout temperature of 1,260 C. to 1,050 C. After the flat passes, the steel product in a single recrystallization coiler pass is reduced to the interim thickness of 1.0" and coiled in one of the coiler furnaces. Both coiler furnaces are maintained at an interior furnace temperature of 1,000 C. (but at least 970 C.) to prevent the steel being rolled from dropping in temperature below the $T_{nr}$ before being reduced to the selected interim thickness.

The steel product preferably stays in the coiler furnace for a period that in combination with the flat passes totals at least 60 seconds. While the above rolling schedule has only one recrystallization coiler pass, it is also acceptable to have multiple recrystallization coiler passes, so long as the total time spent above $T_{nr}$ is at least 60 seconds (or such other period as is suitable to the chemistry of the steel being rolled). However, it is preferable to have only one coiler pass, as this permits the Steckel mill to process another slab (surplus portion) while the first slab (target portion) is held out of the way in the coiler furnace.

Once the intermediate steel product has fallen to $T_{nr}$, it enters the pancaking stage where it is rolled in a series of pancaking coiler passes between $T_{nr}$ and the $Ar_3$, (800 C. in the above example). During the pancaking stage, the first-rolled thickness of 1.0" at about the $T_{nr}$, (which should still be effective for achieving some degree of recrystallization,) is successively reduced. Note that rolling below the $T_{nr}$ will not admit of any further recrystallization, but instead the next rolling sequence pancakes or flattens the crystal structure previously obtained. In this example, the initial 1.0" thickness obtained from rolling at the $T_{nr}$ is reduced by 50% to an end-product thickness 0.50" at the $Ar_3$. This 2:1 reduction in thickness from the $T_{nr}$ thickness to the $Ar_3$ thickness is representative, and tends to generate a preferred degree of pancaking of the fine crystal structure that had been obtained in the austenite (that is, in accordance with the procedure described, transformed predominantly into bainite).

In the above discussion, the assumption has been made that the $T_{nr}$ and the $Ar_3$ can be accurately determined for a given steel product. However, different and somewhat competing approaches to the determination of these critical temperatures are discussed in the technical literature. Depending upon the equations used, the calculated $Ar_3$ (for example) computed according to a given method may differ by as much as about 10 C. from the calculation of the $Ar_3$ using one of the competing methods of calculation. The present invention is not predicated upon any particular selection of method of calculation of the $T_{nr}$ or $Ar_3$. A 10 C. variation at either end of a stated range of temperatures is equally considered not to be material to the practice of the present invention. In any given plant, the metallurgists or the person responsible for mill operation will undoubtedly evaluate rolling and cooling results empirically, and choose a combination of rolling and cooling parameters that appears to give optimum or near-optimum results. However, optimum or near-optimum results should be obtainable with a minimum of empirical adjustment using the combination and methods described and claimed in the present application.

After rolling, the product is subjected to forced cooling suitable for the type of end-product steel desired, e.g. quench-and-tempered steel or bainite-rich steel.

Alternative Embodiments

Figure 6:
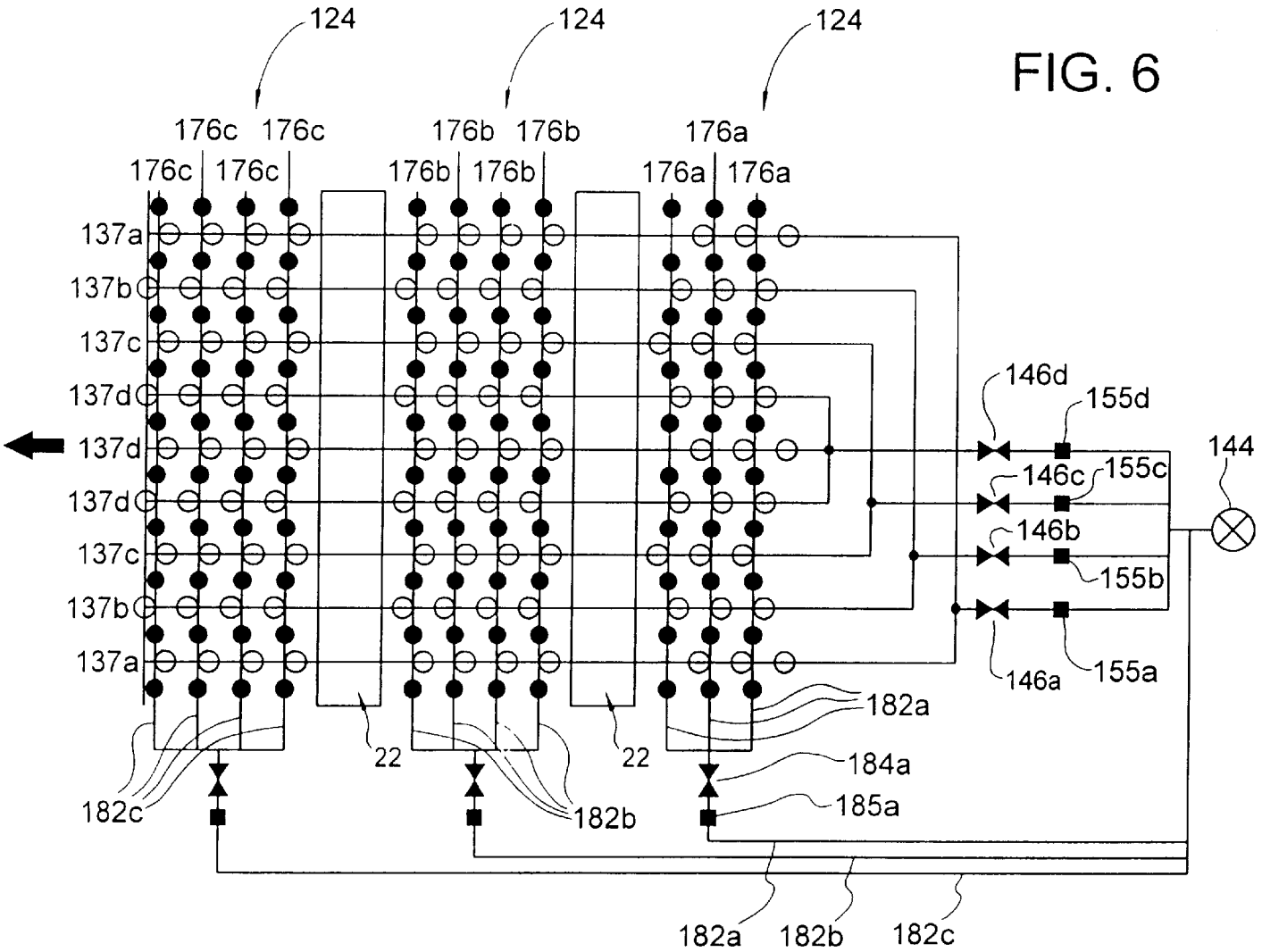
FIG. 6 is schematic plan view of an array of longitudinally adjustable nozzles and transversely adjustable nozzles and supply lines therefor, for use within an upstream quench station according to an embodiment of the invention that provides both transverse and longitudinal adjustment of flow rate of cooling fluid from the nozzles.

FIGS. 5 and 6 illustrate an alternative embodiment of the upstream quench station 14 that includes longitudinal spray control. In this embodiment, there is a second top and bottom arrays of nozzle clusters 170, 172 interspersed with the top and bottom nozzle arrays 126, 128 of the first embodiment, i.e. the array of nozzles that are actuated on a transversely variable basis. For purposes of distinction, the second top and bottom arrays are hereinafter referred to as the longitudinal-control arrays, and the arrays of the first embodiment illustrated in FIGS. 1–4 are referred to as the transverse-control arrays.

The longitudinal-control arrays are actuated on a longitudinally variable basis. To this end, there are opposed top and bottom longitudinal-control arrays of nozzles 170, 172 (FIG. 5) above and below the strand 12, respectively. For convenience, the bottom longitudinal-control array 172 is discussed, it being understood that the discussion also applies to the top longitudinal-control array 170. The longitudinal-control array 172 comprises a plurality of separate longitudinally-spaced banks 176*a*, 176*b*, 176*c* of transversely aligned nozzles ("longitudinal nozzle banks") each having dedicated supply pipes 182*a*, 182*b*, 182*c* that are arranged in a horizontal plane below the bottom transverse-control array 128. Each nozzle 178 of each longitudinal nozzle bank extends from its respective supply pipe 182*a* etc. into the same plane as the nozzles 133 from the bottom transverse control array 128. Each longitudinal nozzle bank 176 spans a width that is at least as wide as the maximum strand width. The nozzles 178 provide spray patterns complementary to the spray patterns provided by the transverse-control nozzle array 128. The arrangement illustrated is exemplary; more longitudinal-control nozzle banks could be provided; more nozzles altogether of smaller capacity and providing smaller spray patterns could be provided, etc.

In this embodiment, the longitudinal supply pipes 182 are connected to associated respective water control valves 184*a*, 184*b*, 184*c* and water pressure regulators 185*a*, 185*b*, 185*c*. Similarly, the longitudinal supply pipes are connected to associated respective air control valves and pressure regulators (not shown) In a manner similar to the transverse spray control described in the first embodiment, the control valves 184 and pressure regulators 185 regulate the fluid flow rate and pressure for the three longitudinally spaced banks 176. Such longitudinal-control is useful in countering non-uniform longitudinal cooling in the strand, which may for example, be caused by anomalies in the orderly progress of the steel through the caster assembly 21. For example, for a given length of the strand, the leading portion may be at a higher temperature than the trailing portion at a given line location. In this connection, the longitudinal-control array may be programmed to apply a higher intensity quench to the leading portion of the strand, and a lower intensity quench to the trailing portion. As the lengthwise strand portions are moving through the upstream quench station 14, the quench intensity for each longitudinally spaced group must be varied depending on which strand portion is directly above (or below for the top longitudinal array 170).

Optionally, the flow rate provided by each longitudinal array nozzle 178 near the center line of the strand may be somewhat larger than that of nozzles 178 near the strand edges. Suitable sizing of the nozzles 178 in the banks 176 can achieve this objective. This variation in flow rate across the bank enables a higher coolant flow rate to be provided by the central nozzles 178 than the outermost nozzles 178, thereby providing a differential transverse cooling to complement the variable control transverse cooling described in the first embodiment, albeit without fine transverse control of the longitudinal-control nozzles. The chosen transverse flow-rate profile would be selected to match within engineering limits the transverse surface temperature profile of an average casting.

The upstream quench station 14 in accordance with this embodiment may be alternatively located downstream of the severing apparatus 13. The steel product that enters the upstream quench station 14 will in such case typically be in the form of slabs severed by the severing apparatus 13. The data and control program parameters of the control unit are appropriately modified to account for the longer distance between the caster assembly 21 exit and the upstream quench station entrance 123, and the time it takes the strand to travel this distance. Locating the upstream quench station 14 further downstream from the caster assembly 21 enables the steel product to cool somewhat in ambient air before it reaches the upstream quench station 14, thereby reducing the amount of water and energy required to quench the product surfaces to the appropriate temperature.

If the upstream quench station 14 is located downstream of the severing apparatus 13, the casting line speed should preferably be kept constant between the caster assembly 21 and reheat furnace 15. As the steel product has been severed into slabs, the casting line speed of the slabs can be changed relative to the casting line speed for the strand. However, when such a speed change occurs, slabs tend to develop a longitudinal temperature gradient. For example, if the speed of the casting line downstream of the severing apparatus increases, the steel product that has exited the caster assembly 21 but not yet entered the upstream quench station 14 will have a downstream portion that will have had more time to cool than an upstream portion. In a typical continuous casting mill, the, casting line speed remains fairly constant between the caster assembly 21 and the reheat furnace 15, and therefore, the occurrence of such longitudinal temperature gradients is minimal. However, should there be a longitudinal temperature gradient, such gradient can be minimized or eliminated by use of the longitudinal spray control described above.

In a further alternative embodiment, a portion of the upstream quench station 14 is installed within the strand containment and straightening apparatus 16 near the caster assembly exit, and operates in conjunction with a portion of the upstream quench station 14 positioned outside the caster assembly 21 to quench the steel product in a manner described for the above two embodiments. Of course, the strand 19 must be completely unbent and straightened before it is quenched.

The location of the upstream quench station 14 in this embodiment is selected to be closely downstream of the caster assembly 21 to minimize the formation of lengthwise and transverse temperature variations along the surfaces of the strand. Such temperature variations if not compensated for tend to cause inconsistent as-quenched properties in the steel. Should temperature variations along the product reach an unacceptable severity, the upstream quench station is fitted with a control system and equipment that provide a controlled spraying system that compensates for the temperature variations, so that after quench spraying in the upstream quench station, the sprayed surfaces have a uniform temperature and the surface layers have a microstructure that is transformed to a uniform depth.

Other alternatives and variants of the above described methods and apparatus suitable for practising the methods will occur to those skilled in the technology.

What is claimed is:

1. An in-line method for producing a rolled steel product, including continuously casting a strand of steel, severing the cast strand transversely into a series of slabs, reheating the slabs to a substantially uniform pre-rolling temperature, and reversingly reduction-rolling the reheated steel slabs;

characterized by:

(a) applying to the cast steel an upstream quench prior to reheating so as to quench a surface layer of the cast steel to a selected depth so that the surface layer is transformed from an austentitic to a substantially non-austentitic microstructure;

(b) shearing the leading edge of the rolled steel immediately after completion of rolling to crop the steel so as to provide a precise transverse vertical face on the leading edge of the rolled steel; and (c) applying to the cropped rolled steel a controlled temperature reduction so as to obtain a microstructure of the steel that includes a substantial portion of bainite or a substantial portion of martensite;

and further characterized in that (d) the slabs are reheated to a suitable pre-rolling temperature above the temperature $T_{nr}$ sufficient to transform the quenched surface layer to fine-grained austenite; and (e) the slabs are reduction rolled first in a temperature range above the temperature $T_{nr}$ and then at a decreasing temperature between the temperatures $T_{nr}$ and $Ar_3$ to obtain first a controlled recrystallization of austenite and then a pancaking or flattening of the austenite grains.

2. The method of claim 1, wherein the controlled temperature reduction comprises cooling the rolled steel at a rate of about 12 C to 20 C per second and to a temperature of about 200 C. to about 350 C. below the temperature $Ar_3$, thereby obtaining in the rolled steel a microstructure including a substantial portion of fine-grained bainite.

3. The method of claim 1, wherein the controlled temperature reduction comprises a downstream quench immediately followed by a martensite sustaining cooling, the quench being sufficient to obtain a microstructure including a substantial portion of fine-grained martensite, and the sustaining cooling being sufficient to substantially maintain and preferably to increase the portion of fine-grained martensite obtained in the rolled steel.

4. The method of claim 3, additionally including tempering the rolled steel following the sustaining cooling step.

5. The method of claim 1, wherein the controlled temperature reduction is effected at least in part by laminar flow cooling.

6. The method of claim 1, wherein the upstream quench is applied transversely differentially to compensate for the transverse surface temperature profile of the cast steel.

7. The method of claim 1, wherein the reduction rolling comprises (i) a selected number of flat-pass rolling passes above $T_{nr}$ to achieve a selected flat-pass reduction of the thickness of the steel and recrystallization of the austentite in the steel being rolled, then (ii) a selected number of initial coiler passes performed while the steel is of coilable thickness and the temperature of the steel is above the $T_{nr}$, each said initial coiler pass comprising reducing the steel and then coiling the product in a heated environment at a temperature above the $Ar_3$, then (iii) a selected number of final coiler passes performed while the temperature of the steel is above the $Ar_3$, each said final coiler pass comprising reducing the steel and then coiling the product in a heated environment at a temperature above the $Ar_3$.

8. The method defined in claim 7, wherein the reduction rolling prior to the final coiler passes reduces the thickness of the steel by a factor in the order of at least 1.5:1 and wherein the final coiler passes reduce the thickness of the steel by a factor in the order of at least 2:1 so that the overall combined reduction of the steel is at least about 3:1.

9. The method defined in claim 8, for optimizing the production of steel products in circumstances in which the rolling mill is limited at least in part by coiler furnace capacity and by the inability of the coiler furnaces to coil steel above a maximum coilable thickness;

characterized by rolling a maximum-weight slab exceeding the coiler furnace capacity and severing the slab to obtain an end-product of a target weight and target dimensions, the target weight of the particular end-product of target dimensions being limited by the coiler furnace capacity; and further characterized by (a) flat-pass reduction rolling the maximum-weight slab from a pre-rolled thickness to produce an interim steel product of a severable thickness exceeding the maximum coilable thickness; then (b) transversely severing the interim steel product into two portions, viz a pre-determined target portion having a target weight selected to be within the coiler furnace capacity, and a residual surplus portion;

(c) flat-pass rolling the target portion to further reduce the target portion from the severable thickness to a thickness not exceeding the maximum coilable thickness;

(d) coiling the target portion in one of the coiler furnaces;

(e) flat-pass rolling the surplus portion from the severable thickness to a desired end-product thickness; then (f) transferring the surplus portion downstream for further processing to obtain a surplus end-product.

10. The method as claimed in claim 9, additionally including, after completion of step (f), (g) flat-pass rolling the target portion to a plate of desired end-product thickness, then directing the target portion downstream for processing as plate end-product.

* * * * *

UNITED STATES PATENT AND TRADEMARK OFFICE

CERTIFICATE OF CORRECTION

PATENT NO. : 6,264,767 B1
DATED : July 24, 2001
INVENTOR(S) : Frank et al.

It is certified that error appears in the above-identified patent and that said Letters Patent is hereby corrected as shown below:

Column 1,
Line 11, change "08,870,470," to -- 08/870,470 --.

Column 3,
Line 42, following "austenite" add -- recrystallization. --.

Column 4,
Line 41, change "an" to -- a --.

Column 5,
Line 11, change "do" to -- to --.

Column 7,
Line 8, change "a" to -- an --.

Column 10,
Line 42, change "56" to -- 156 --.

Column 13,
Line 2, change "ALN" to -- A1N --;
Line 47, change "suitable" to -- suitably --;
Line 64, following "order" add -- to --.

Column 15,
Line 19, change "a" to -- an --;
Line 26, change "a" to -- an --;
Line 32, change "Tand" to -- Tnr and --.

Column 17,
Line 29, change "an" to -- a --.

Column 18,
Line 8, change "are" to -- of --.

Column 20,
Line 44, change "time the it" to -- time it --;
Line 56, remove "patent and".

UNITED STATES PATENT AND TRADEMARK OFFICE

CERTIFICATE OF CORRECTION

PATENT NO. : 6,264,767 B1
DATED : July 24, 2001
INVENTOR(S) : Frank et al.

It is certified that error appears in the above-identified patent and that said Letters Patent is hereby corrected as shown below:

Column 22,
Line 10, change "1/4"" to -- 1/4 --;
Line 63, change "date" to -- data --.

Column 24,
Line 67, change "shown)" to -- shown). --.

Claim 1,
Line 10, change "austentitic" to -- austenitic --;
Line 11, change "non-austentitic" to -- non-austenitic --.

Claim 7,
Line 5, change "austentite" to -- austenite --.

Signed and Sealed this

Ninth Day of April, 2002

*Attest:*

*Attesting Officer*

JAMES E. ROGAN
*Director of the United States Patent and Trademark Office*